US009240653B2

(12) United States Patent
Urano et al.

(10) Patent No.: US 9,240,653 B2
(45) Date of Patent: Jan. 19, 2016

(54) WIRE-TO-BOARD CONNECTOR

(71) Applicant: Japan Aviation Electronics Industry, Ltd., Tokyo (JP)

(72) Inventors: Tetsu Urano, Tokyo (JP); Takaaki Kudo, Tokyo (JP)

(73) Assignee: JAPAN AVIATION ELECTRONICS INDUSTRY, LTD., Tokyo (JP)

( * ) Notice: Subject to any disclaimer, the term of this patent is extended or adjusted under 35 U.S.C. 154(b) by 0 days.

(21) Appl. No.: 14/386,630

(22) PCT Filed: Feb. 8, 2013

(86) PCT No.: PCT/JP2013/000707
§ 371 (c)(1),
(2) Date: Feb. 11, 2015

(87) PCT Pub. No.: WO2013/145527
PCT Pub. Date: Oct. 3, 2013

(65) Prior Publication Data

US 2015/0155658 A1 Jun. 4, 2015

(30) Foreign Application Priority Data

Mar. 27, 2012 (JP) ..... 2012-072085
Nov. 9, 2012 (JP) ..... 2012-247408

(51) Int. Cl.

| | |
|---|---|
| ***H01R 12/00*** | (2006.01) |
| ***H01R 13/639*** | (2006.01) |
| ***H01R 13/627*** | (2006.01) |
| ***H01R 12/71*** | (2011.01) |
| ***H01R 12/83*** | (2011.01) |
| *H01R 12/81* | (2011.01) |

(52) U.S. Cl.
CPC ..... *H01R 13/639* (2013.01); *H01R 12/716* (2013.01); *H01R 12/83* (2013.01); *H01R 13/6273* (2013.01); *H01R 12/81* (2013.01)

(58) Field of Classification Search
CPC .. H01R 13/639; H01R 12/70; H01R 12/7005; H01R 12/53; H01R 12/712; H01R 12/718; H01R 12/83; H01R 12/716; H01R 13/6273; H01R 12/81
USPC ..... 439/78
See application file for complete search history.

(56) References Cited

U.S. PATENT DOCUMENTS

| | | | | |
|---|---|---|---|---|
| 7,329,158 | B1 * | 2/2008 | Roberts et al. | H01R 13/115 439/825 |
| 9,039,429 | B2 * | 5/2015 | Shimoji | H01R 12/728 439/81 |
| 2006/0094305 | A1 | 5/2006 | Masaki et al. | |
| 2008/0305668 | A1 * | 12/2008 | Wu | H01R 9/091 439/272 |
| 2014/0302694 | A1 * | 10/2014 | Qiao | H01R 12/7023 439/78 |

FOREIGN PATENT DOCUMENTS

| | | | |
|---|---|---|---|
| JP | 2006-128032 | A | 5/2006 |
| JP | 2006-128034 | A | 5/2006 |
| JP | 4020907 | B2 | 10/2007 |

OTHER PUBLICATIONS

International Search Report dated Apr. 2, 2013 from corresponding International Patent Application No. PCT/JP2013/000707; 1 pg.

* cited by examiner

*Primary Examiner* — Jean F Duverne
(74) *Attorney, Agent, or Firm* — Maier & Maier, PLLC

(57) ABSTRACT

A plug side surface of a plug housing is provided with a claw portion. The claw portion includes a plug lock surface facing in a direction away from a connector mounting surface. Each assistant fitting of a receptacle connector includes a receptacle lock surface that faces in a direction approaching the connector mounting surface and is opposed to the plug lock surface in a mated state. The plug lock surface includes a lock maintaining surface and an unlocking surface. Further an angle formed between a reference plane and the lock maintaining surface is a lock maintaining angle and an angle formed between the reference plane and the unlocking surface is an unlocking angle, the lock maintaining angle is smaller than the unlocking angle.

14 Claims, 36 Drawing Sheets

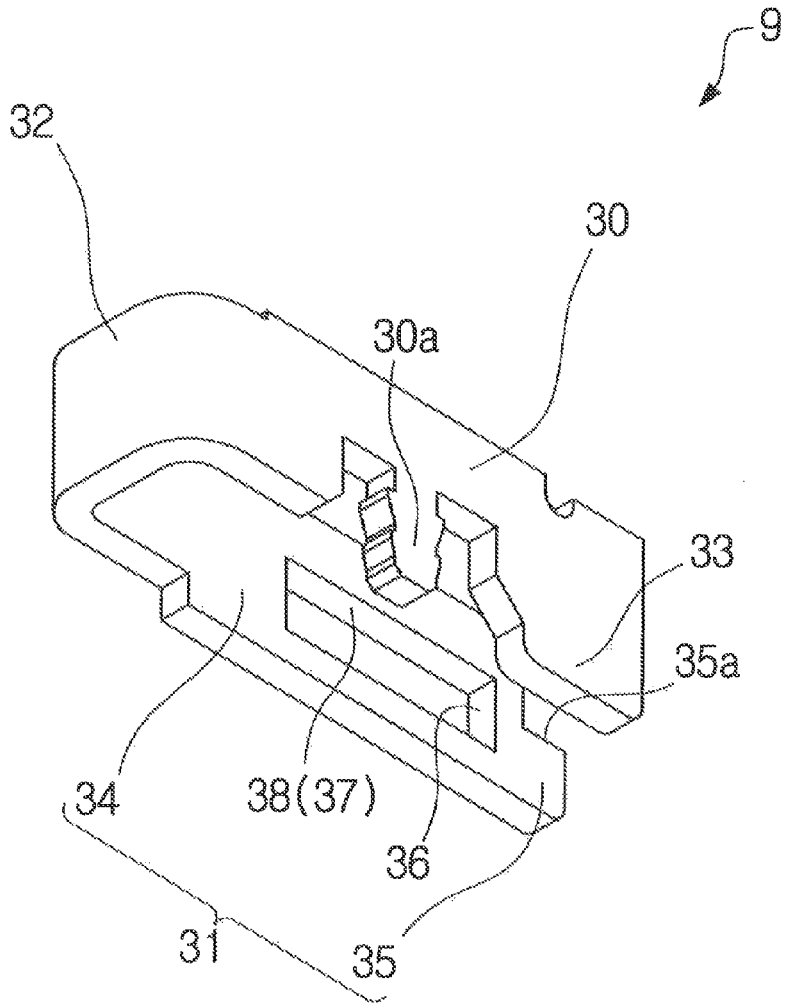
Fig. 12
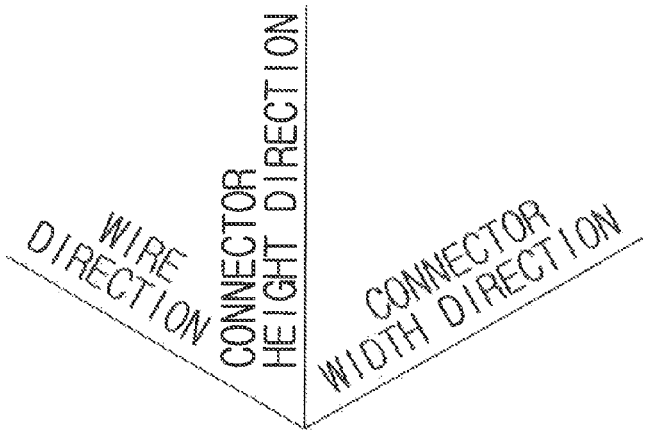

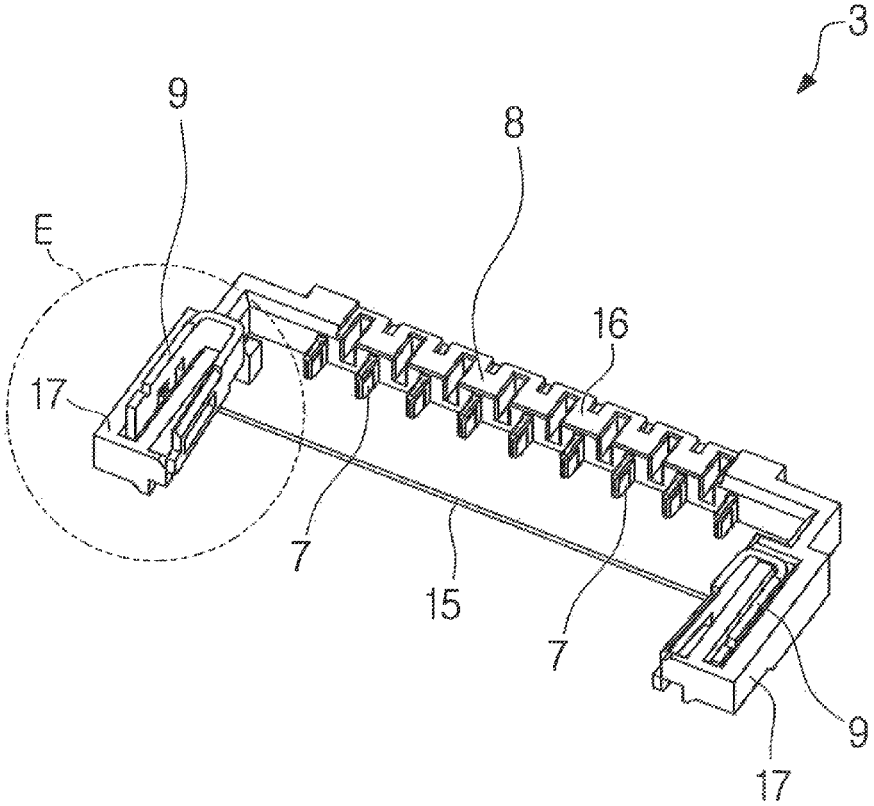
Fig. 13
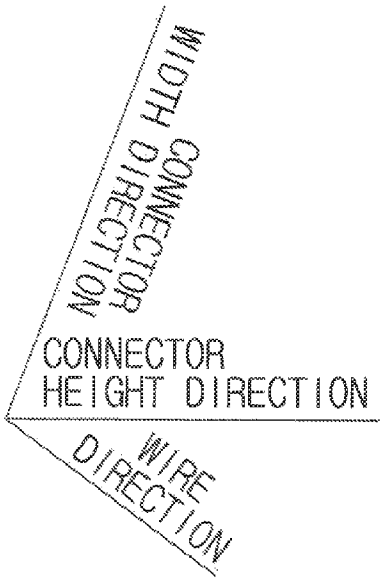

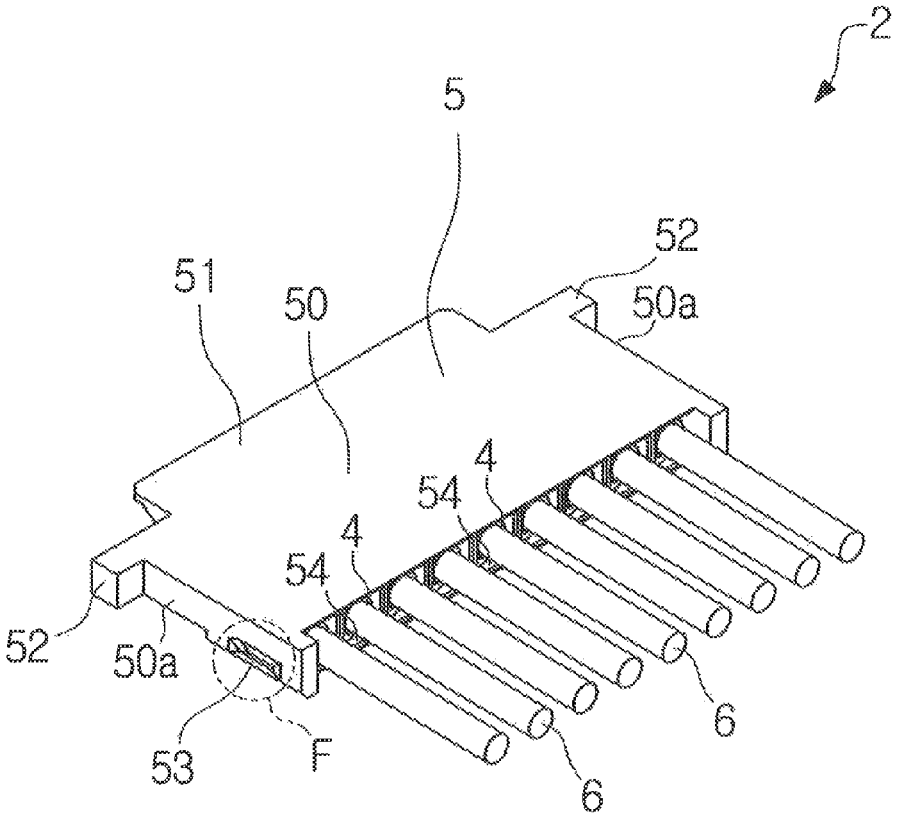
Fig. 17
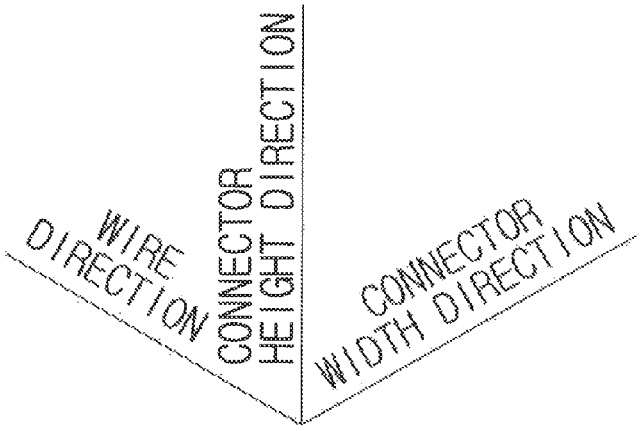

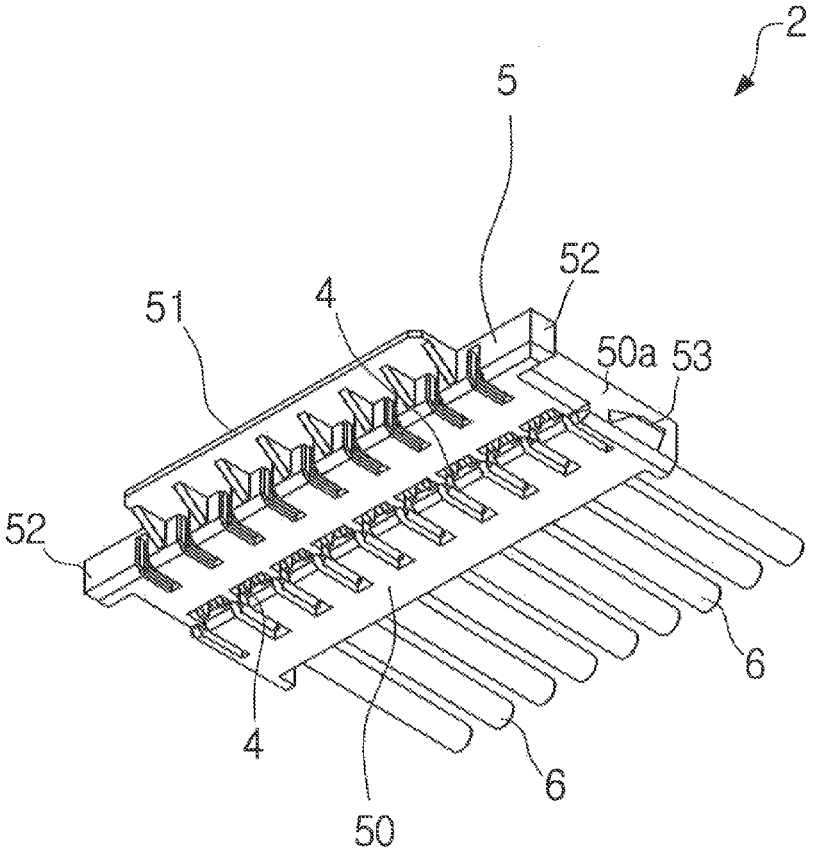
Fig. 18
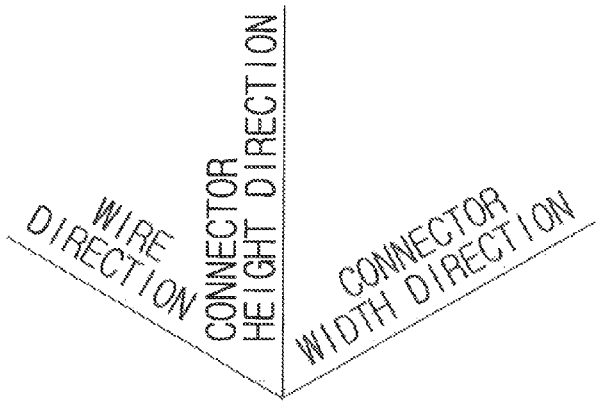

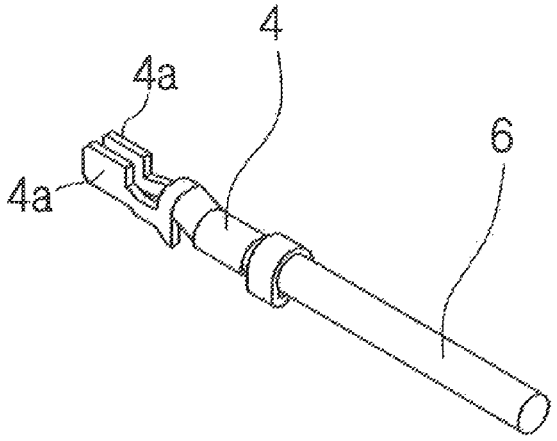
Fig. 19
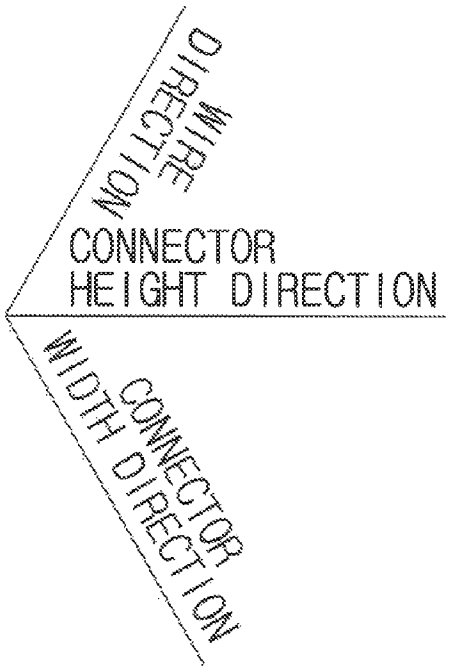

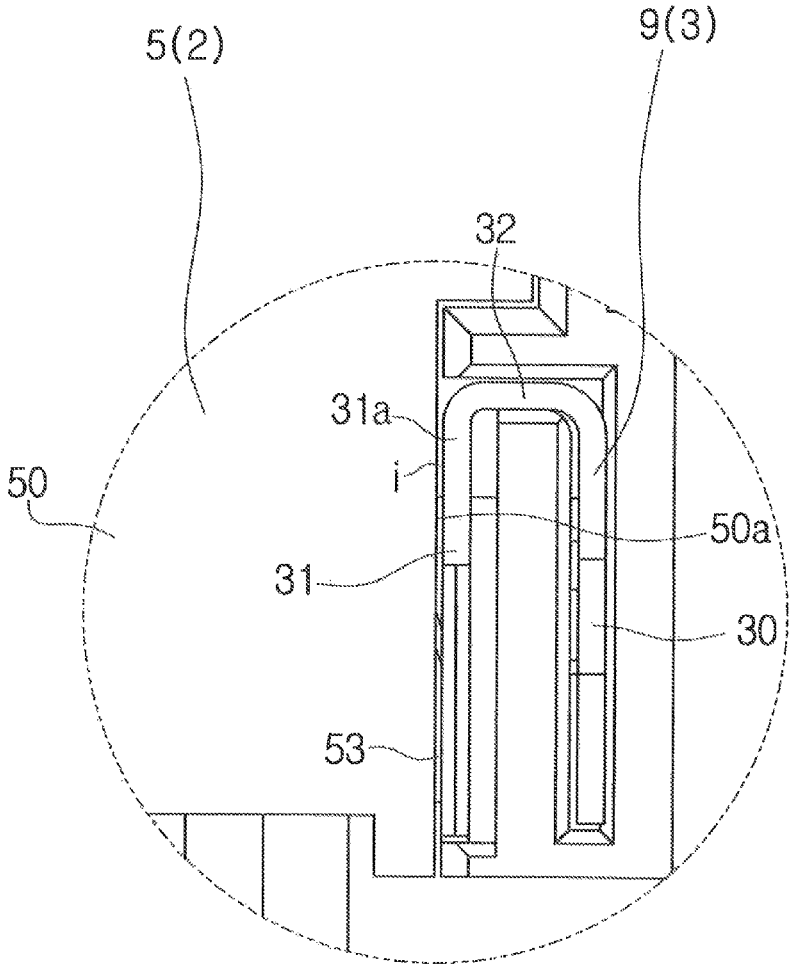
Fig. 32
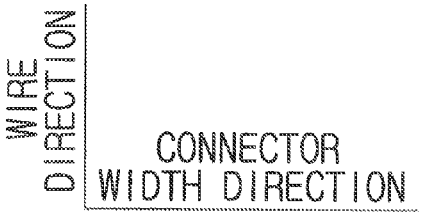

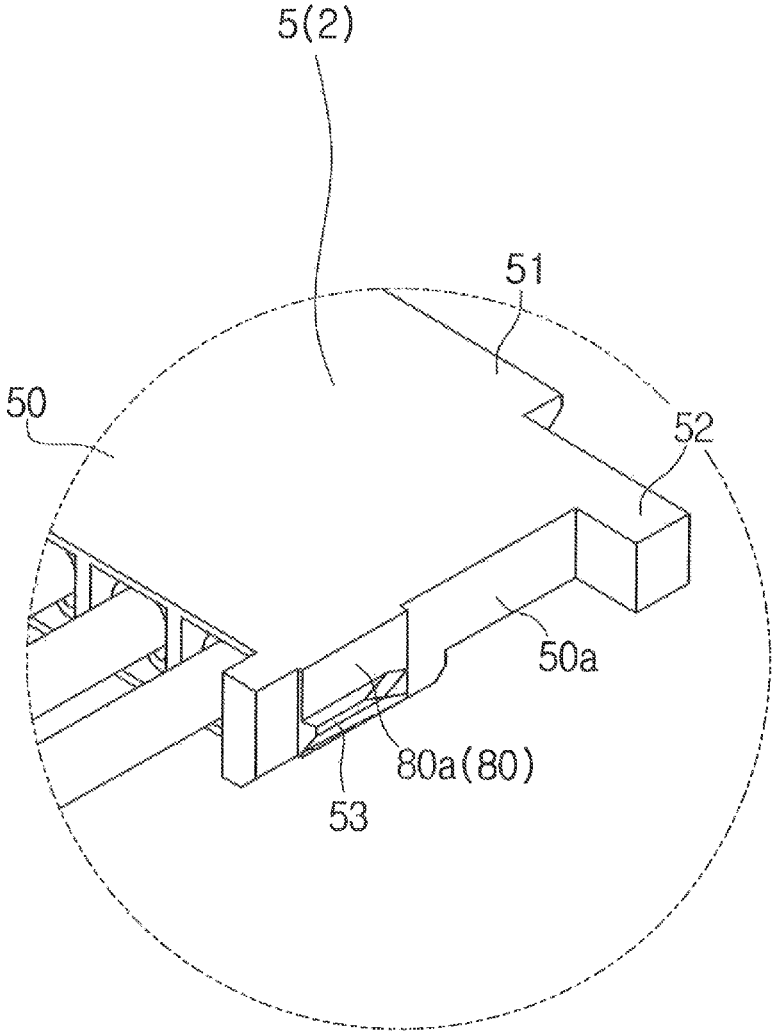
Fig. 33
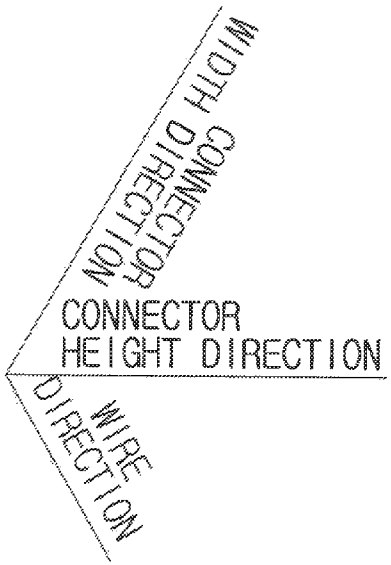

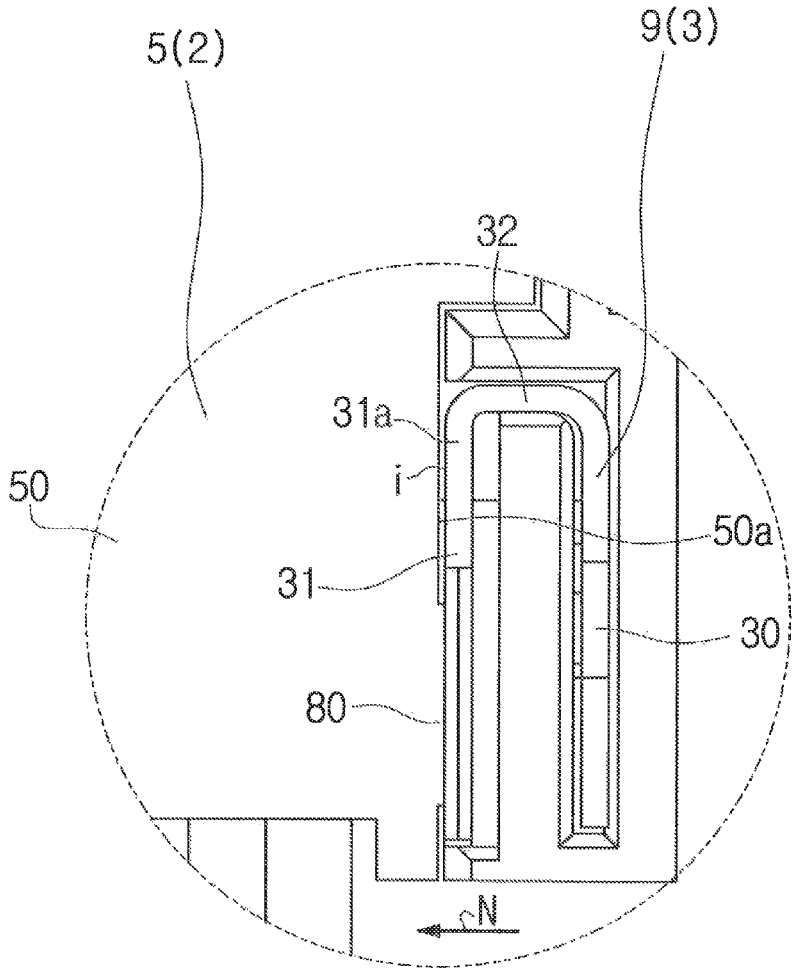
Fig. 34
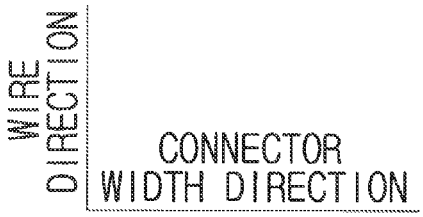

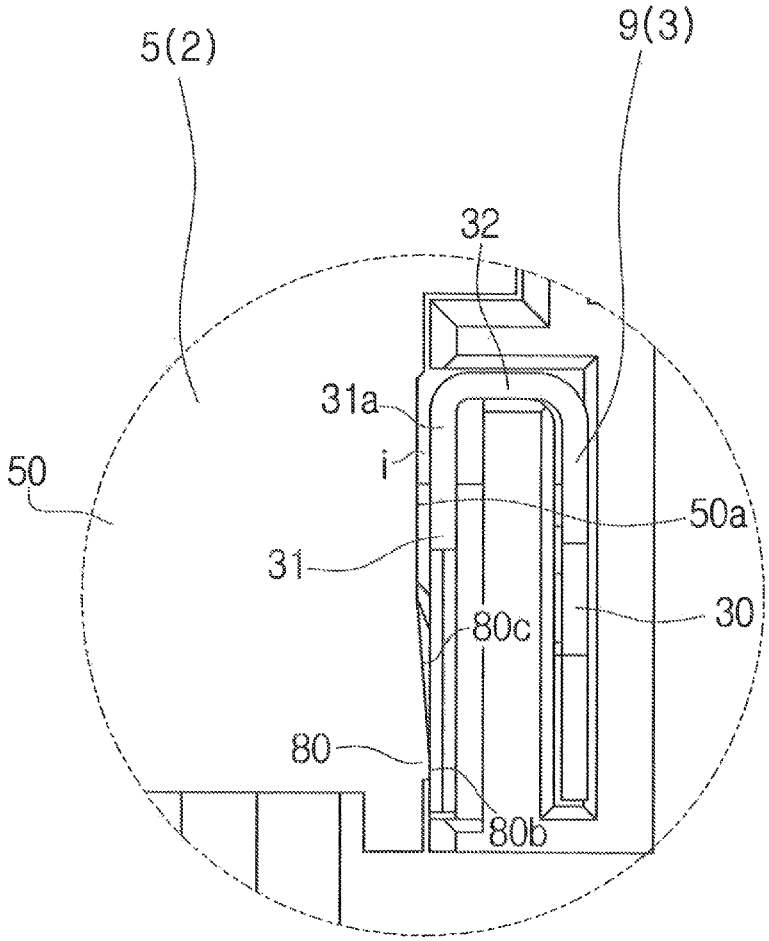
Fig. 36
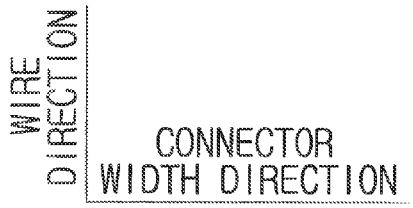

WIRE-TO-BOARD CONNECTOR

TECHNICAL FIELD

The present invention relates to a wire-to-board connector.

BACKGROUND ART

As a technique of this type, Patent Literature 1 discloses a connector including a socket connector 100 shown in FIG. 29 of this application, and a base connector 101 shown in FIG. 30 of this application.

The socket connector 100 includes a housing 102 and a plurality of socket contacts (not shown) which are engaged with the housing 102. Lead wires extending substantially forward are respectively attached to the socket contacts.

The base connector 101 is fixed to a printed circuit board by solder joining. The base connector 101 includes a housing 103 and a plurality of contacts 104 which are held by the housing 103. The housing 103 has a recess 105 which is opened in a direction away from the printed circuit board. The socket connector 100 is inserted into and removed from the recess 105 of the base connector 101 along an inserting/removing direction which is orthogonal to the printed circuit board.

A pair of lock pieces 106 is formed so as to protrude from an end face of the housing 102 of the socket connector 100. A pair of mating grooves 107 is formed in the housing 103 of the base connector 101. In the state where the socket connector 100 and the base connector 101 are coupled together, the pair of lock pieces 106 of the housing 102 of the socket connector 100 are respectively mated with the pair of mating grooves 107. The pair of lock pieces 106 and the pair of mating grooves 107 constitute a lock mechanism for maintaining the state in which the socket connector 100 is engaged with base connector 101.

CITATION LIST

Patent Literature

[Patent Literature 1] Japanese Patent No. 4020907

SUMMARY OF INVENTION

Technical Problem

However, in the structure disclosed in Patent Literature 1 described above, there is a possibility that the socket connector 100 is disengaged from the base connector 101 when the lead wires are raised in the direction away from the printed circuit board. Meanwhile, there is a potential need for removing the socket connector 100 from the base connector 101 depending on the situation.

It is an object of the present invention to provide a connector capable of maintaining a mated state even when a wire is raised in a direction away from a board and capable of intentionally releasing the mated state.

Solution to Problem

According to a first aspect of the present invention, there is provided a wire-to-board connector including: a plug connector including a plug contact to which a wire is attached, and a plug housing that holds the plug contact; and a receptacle connector that is mounted on a connector mounting surface of a board and includes a receptacle contact corresponding to the plug contact, and a receptacle housing that holds the receptacle contact, the plug connector being mated with the receptacle connector to thereby allow the plug contact to contact the receptacle contact. In a mated state in which the plug connector is mated with the receptacle connector, a vicinity portion of the wire, the vicinity portion being located in the vicinity of the plug connector, extends along the connector mounting surface of the board. A mating direction in which the plug connector is mated with the receptacle connector is a direction approaching the connector mounting surface of the board. The plug housing includes a plug side surface as a side surface of the plug housing. The receptacle connector includes a side surface opposing portion that is opposed to the plug side surface in the mated state. The plug side surface is provided with a claw portion projecting toward the side surface opposing portion. The claw portion includes a plug lock surface that faces in a direction away from the connector mounting surface of the board and extends in a wire direction specified as a longitudinal direction of the vicinity portion in the mated state. The side surface opposing portion of the receptacle connector includes a receptacle lock surface that faces in a direction approaching the connector mounting surface of the board and is opposed to the plug lock surface in the mated state. The plug lock surface includes a lock maintaining surface disposed on a side in a connector wire direction in which the wire is viewed from the plug connector in the wire direction, and an unlocking surface disposed on a side in a wire connector direction which is opposite to the connector wire direction. In a cross-section orthogonal to the wire direction, assuming that an angle formed between the lock maintaining surface and a reference plane that is a portion of the plug side surface located on a side farther from the connector mounting surface of the board than the claw portion is a lock maintaining angle $\theta 1$ and an angle formed between the reference plane and the unlocking surface is an unlocking angle $\theta 2$, the lock maintaining angle $\theta 1$ is smaller than the unlocking angle $\theta 2$.

Preferably, the unlocking angle $\theta 2$ is greater than 90 degrees.

Preferably, the lock maintaining angle $\theta 1$ is equal to or smaller than 90 degrees.

Preferably, the unlocking surface is inclined so as to approach the plug side surface in the wire connector direction.

Preferably, the unlocking surface is connected to an edge of the lock maintaining surface on a side far from the plug side surface.

Preferably, at an end in the wire connector direction of the claw portion, an inclined surface that is inclined so as to approach the plug side surface in the wire connector direction is formed, and the inclined surface is connected to the unlocking surface.

Preferably, the side surface opposing portion includes a lock piece supporting portion and a lock piece that is supported by the lock piece supporting portion; the lock piece is formed in a cantilever shape including a lock piece held portion that is held by the lock piece supporting portion, and a lock piece opposing portion that is opposed to the plug side surface; the lock piece opposing portion is elastically displaceable in a direction away from the plug side surface; and the receptacle lock surface is formed in the lock piece opposing portion.

Preferably, the side surface opposing portion includes a displacement regulating portion that is disposed on a side opposite to the connector mounting surface of the board with the lock piece opposing portion interposed therebetween, thereby regulating the lock piece opposing portion from being elastically displaced in a direction away from the connector mounting surface of the board.

Preferably, the lock piece held portion and the lock piece opposing portion are formed so as to extend in the wire direction.

Preferably, an end in the wire connector direction of the lock piece held portion is coupled with an end in the wire connector direction of the lock piece opposing portion.

Preferably, the plug housing is provided with a releasing projection that allows the plug connector to be inclined in such a manner that the wire approaches the connector mounting surface of the board.

Preferably, the releasing projection is formed so as to protrude in the wire connector direction from an end in the wire connector direction of the plug housing.

According to a second aspect of the present invention, there is provided a wire-to-board connector including: a plug connector including a plug contact to which a wire is attached, and a plug housing that holds the plug contact; and a receptacle connector that is mounted on a connector mounting surface of a board and includes a receptacle contact corresponding to the plug contact, and a receptacle housing that holds the receptacle contact, the plug connector being mated with the receptacle connector to thereby allow the plug contact to contact the receptacle contact. In a mated state in which the plug connector is mated with the receptacle connector, a vicinity portion of the wire, the vicinity portion being located in the vicinity of the plug connector, extends along the connector mounting surface of the board. A mating direction in which the plug connector is mated with the receptacle connector is a direction approaching the connector mounting surface of the board. The plug housing includes a plug side surface as a side surface of the plug housing. The receptacle connector includes a side surface opposing portion that is opposed to the plug side surface in the mated state. The plug side surface is provided with a claw portion projecting toward the side surface opposing portion. The claw portion includes a plug lock surface that faces in a direction away from the connector mounting surface of the board and extends in a wire direction specified as a longitudinal direction of the vicinity portion in the mated state. The side surface opposing portion of the receptacle connector includes a receptacle lock surface that faces in a direction approaching the connector mounting surface of the board and is opposed to the plug lock surface in the mated state. The plug lock surface includes a lock maintaining surface disposed on a side in a connector wire direction in which the wire is viewed from the plug connector in the wire direction, and an unlocking surface disposed on a side in a wire connector direction which is opposite to the connector wire direction. The unlocking surface is formed to be curved so as to approach the connector mounting surface of the board in a direction away from the plug side surface.

According to the second aspect of the present invention, there is provided a wire-to-board connector including: a plug connector including a plug contact to which a wire is attached, and a plug housing that holds the plug contact; and a receptacle connector that is mounted on a connector mounting surface of a board and includes a receptacle contact corresponding to the plug contact, and a receptacle housing that holds the receptacle contact, the plug connector being mated with the receptacle connector to thereby allow the plug contact to contact the receptacle contact. In a mated state in which the plug connector is mated with the receptacle connector, a vicinity portion of the wire, the vicinity portion being located in the vicinity of the plug connector, extends along the connector mounting surface of the board. A mating direction in which the plug connector is mated with the receptacle connector is a direction approaching the connector mounting surface of the board. The plug housing includes a plug side surface as a side surface of the plug housing. The receptacle connector includes a side surface opposing portion that is opposed to the plug side surface in the mated state. The plug side surface is provided with a claw portion projecting toward the side surface opposing portion. The claw portion includes a plug lock surface that faces in a direction away from the connector mounting surface of the board and extends in a wire direction specified as a longitudinal direction of the vicinity portion in the mated state. The side surface opposing portion of the receptacle connector includes a receptacle lock surface that faces in a direction approaching the connector mounting surface of the board and is opposed to the plug lock surface in the mated state. The plug lock surface includes a lock maintaining surface disposed on a side in a connector wire direction in which the wire is viewed from the plug connector in the wire direction, and an unlocking surface disposed on a side in a wire connector direction which is opposite to the connector wire direction. In a cross-section orthogonal to the wire direction, assuming that an angle formed between the lock maintaining surface and a reference plane that is a portion of the plug side surface located on a side farther from the connector mounting surface of the board than the claw portion is a lock maintaining angle $\theta 1$ and an angle formed between the reference plane and the unlocking surface is an unlocking angle $\theta 2$, the lock maintaining angle $\theta 1$ is smaller than the unlocking angle $\theta 2$. The side surface opposing portion includes a lock piece supporting portion and a lock piece that is supported by the lock piece supporting portion. The lock piece is formed in a cantilever shape including a lock piece held portion that is held by the lock piece supporting portion, and a lock piece opposing portion that is opposed to the plug side surface. The lock piece opposing portion is elastically displaceable in a direction away from the plug side surface. The plug side surface of the plug housing is provided with an overhanging portion projecting toward the lock piece of the side surface opposing portion, and the overhanging portion is in contact with an elastically displaceable portion of the lock piece opposing portion in the mated state.

Advantageous Effects of Invention

When the wire is raised in the direction away from the connector mounting surface of the board and the plug connector is inclined, the lock maintaining surface contacts the receptacle lock surface in advance of the unlocking surface. On the other hand, when the plug connector is intentionally inclined in such a manner that the wire approaches the connector mounting surface of the board, the unlocking surface contacts the receptacle lock surface in advance of the lock maintaining surface. Thus, according to the structure described above, when the wire is raised in the direction away from the connector mounting surface of the board, the mated state is easily maintained without releasing the opposed relationship between the plug lock surface and the receptacle lock surface, and when the plug connector is intentionally inclined in such a manner that the wire approaches the connector mounting surface of the board, the opposed relationship between the plug lock surface and the receptacle lock surface is released and thus the mated state is easily released. Consequently, a wire-to-board connector capable of maintaining the mated state even when the wire is raised in the direction away from the connector mounting surface of the board and capable of intentionally releasing the mated state is achieved.

BRIEF DESCRIPTION OF DRAWINGS

FIG. 12 is a perspective view of the assistant fitting when viewed from another angle (first embodiment);

FIG. 13 is an explanatory view showing an assembly of the receptacle connector (first embodiment);

FIG. 17 is a perspective view of a plug connector in a state where a plurality of wires are attached to the plug connector (first embodiment);

FIG. 18 is a perspective view of the plug connector in the state where the plurality of wires are attached to the plug connector, when viewed from another angle (first embodiment);

FIG. 19 is a perspective view of a plug contact in a state where a wire is attached to the plug contact (first embodiment);

FIG. 32 is an enlarged view of a portion "G" shown in FIG. 31;

FIG. 33 is a partial perspective view of a plug connector to which a plurality of wires are attached (second embodiment);

FIG. 34 is a diagram corresponding to FIG. 32 (second embodiment);

FIG. 36 is a diagram corresponding to FIG. 34 (third embodiment)

DESCRIPTION OF EMBODIMENTS

First Embodiment (Wire-to-Board Connector 1)

Figure 1:
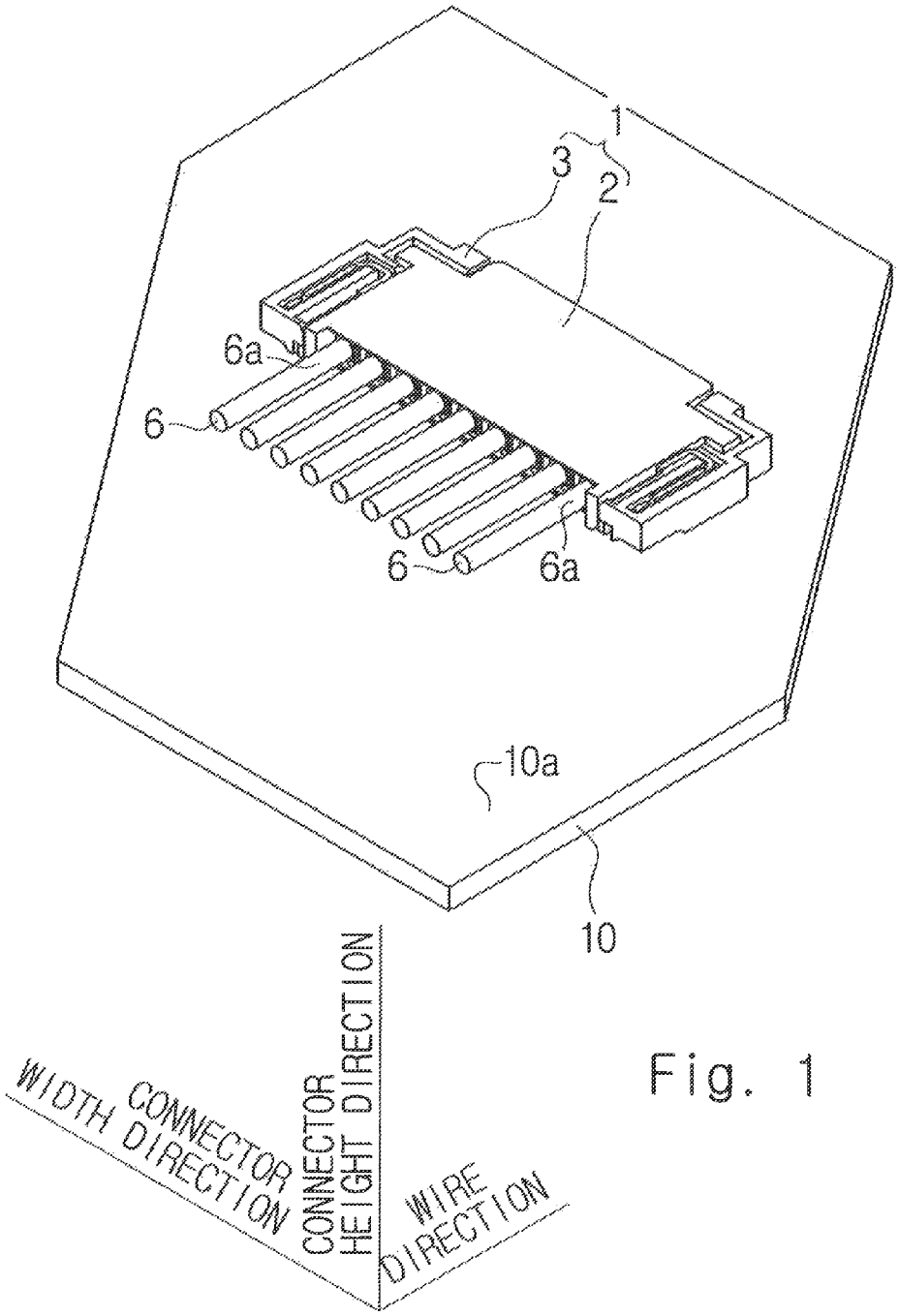
FIG. 1 is a perspective view showing a mated state of a wire-to-board connector (first embodiment)
Figure 2:
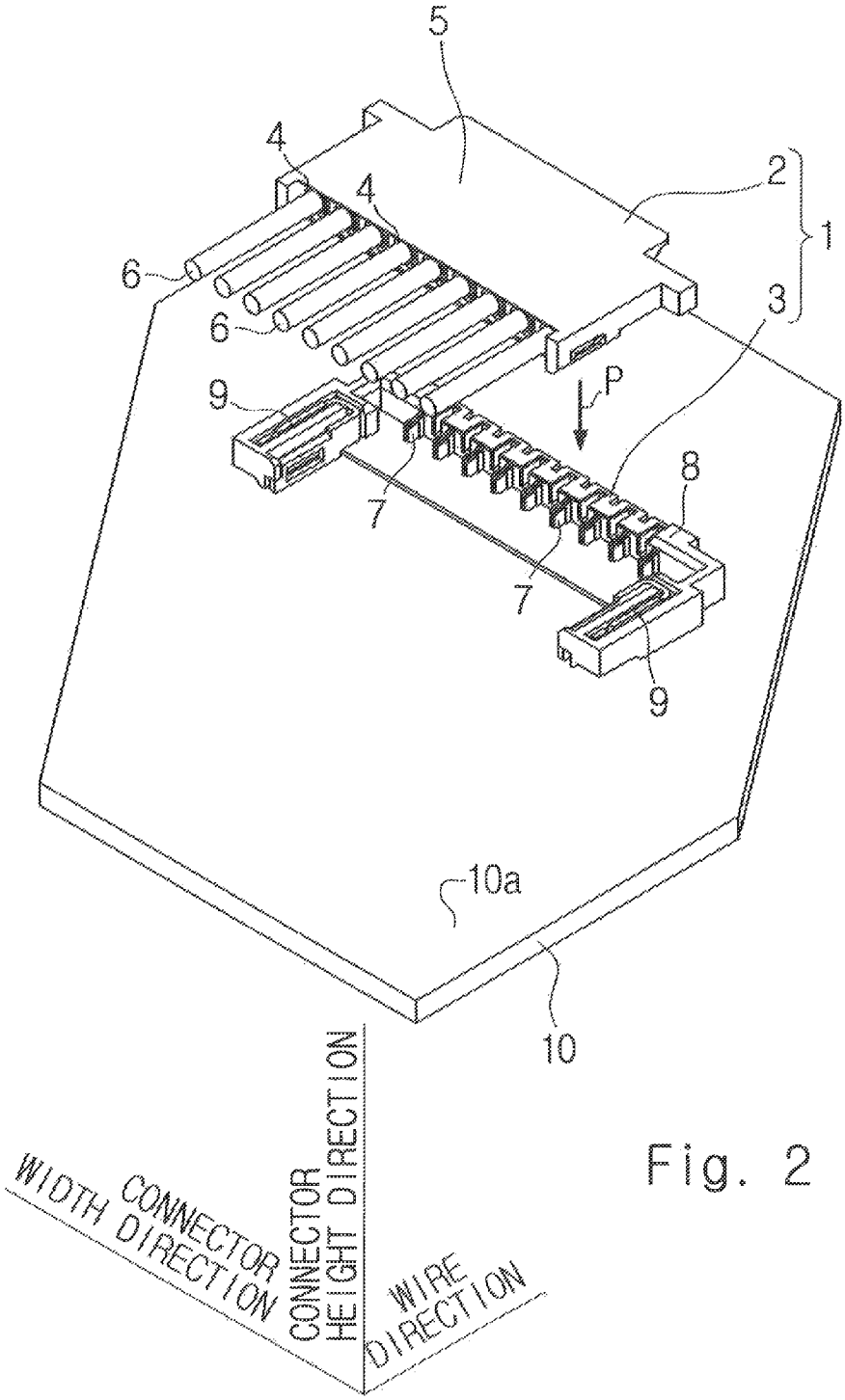
FIG. 2 is a perspective view showing an unmated state of the wire-to-board connector (first embodiment)

A first embodiment of the present invention will be described below with reference to FIGS. 1 to 26. As shown in FIGS. 1 and 2, a wire-to-board connector 1 includes a plug connector 2 and a receptacle connector 3.

As shown in FIG. 2, the plug connector 2 includes a plurality of plug contacts 4 and a plug housing 5 that holds the plurality of plug contacts 4. Wires 6 are respectively attached to the plug contacts 4.

The receptacle connector 3 includes a plurality of receptacle contacts 7, a receptacle housing 8 which holds the plurality of receptacle contacts 7, and a pair of assistant fittings 9 (lock pieces). The receptacle contacts 7 respectively correspond to the plug contacts 4. The receptacle connector 3 is mounted on a connector mounting surface 10*a* of a circuit board 10 (board).

As shown in FIG. 1, the plug connector 2 is mated with the receptacle connector 3, thereby allowing the plug contacts 4 to respectively contact the receptacle contacts 7.

The terms "wire direction", "connector height direction", and "connector width direction" are now defined. The term "wire direction" refers to a direction specified as a longitudinal direction of a vicinity portion 6*a*, which is a portion in the vicinity of the plug connector 2 of the wire 6, in a mated state in which the plug connector 2 is mated with the receptacle connector 3 as shown in FIG. 1. In this embodiment, when the wire-to-board connector 1 is in the mated state, the vicinity portion 6*a* of each wire 6 extends along the connector mounting surface 10*a* of the circuit board 10. Accordingly, it can be said that the wire direction is parallel to the connector mounting surface 10*a* of the circuit board 10. In the "wire direction", a direction in which the plurality of wires 6 are viewed from the plug connector 2 is defined as a connector wire direction and a direction in which the plug connector 2 is viewed from the plurality of wires 6 is defined as a wire connector direction. The term "connector height direction" refers to a direction orthogonal to the connector mounting surface 10*a* of the circuit board 10. The connector height direction is orthogonal to the wire direction. In the "connector height direction", a direction approaching the connector mounting surface 10*a* of the circuit board 10 is defined as a board approaching direction and a direction separating from the connector mounting surface 10*a* of the circuit board 10 is defined as a board separating direction. The term "connector width direction" refers to a direction orthogonal to the wire direction and the connector height direction. The connector width direction is parallel to the connector mounting surface 10*a* of the circuit board 10. In the "connector width direction", a direction approaching the center of the wire-to-board connector 1 is defined as a "connector width center direction" and a direction separating from the center of the wire-to-board connector 1 is defined as a "connector width anti-center direction".

In the following description, each component of the wire-to-board connector 1 will be described by using the terms "wire direction", "connector height direction", and "connector width direction", which are defined in the mated state in which the plug connector 2 is mated with the receptacle connector 3.

As shown in FIGS. 1 and 2, in this embodiment, a mating direction P in which the plug connector 2 is mated with the receptacle connector 3 is a direction approaching the connector mounting surface 10*a* of the circuit board 10. Specifically, the mating direction P is orthogonal to the connector mounting surface 10*a* of the circuit board 10. Accordingly, the mating direction P coincides with the board approaching direction.

The plurality of wires 6 are arranged side by side in the connector width direction. Similarly, the plurality of receptacle contacts 7 are arranged side by side in the connector width direction.

(Receptacle Connector 3)

Next, the receptacle connector 3 will be described in detail with reference to FIGS. 3 to 16.

Figure 3:
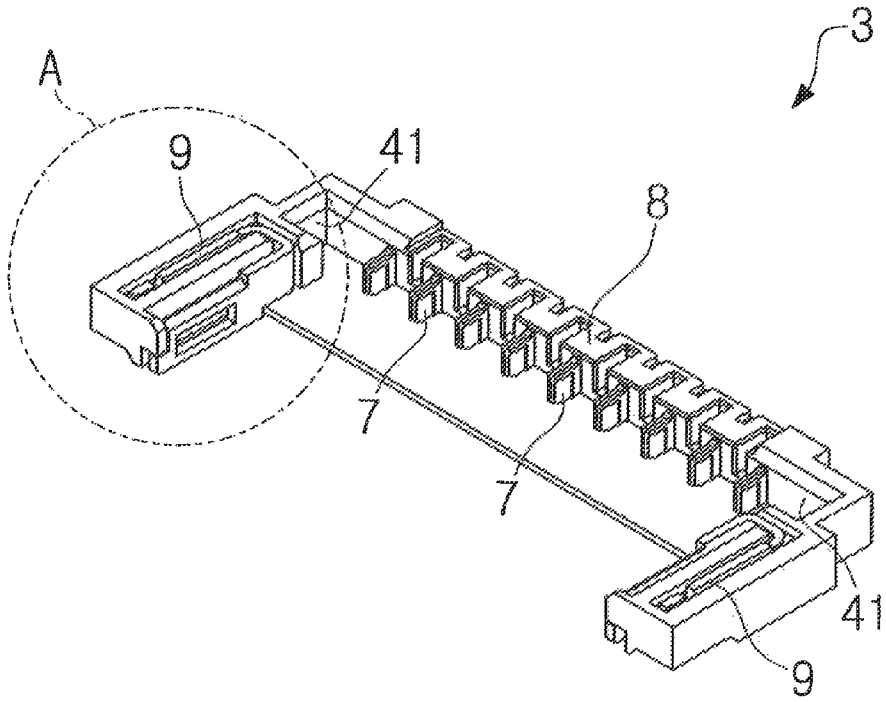
FIG. 3 is a perspective view of a receptacle connector (first embodiment)
Figure 3:
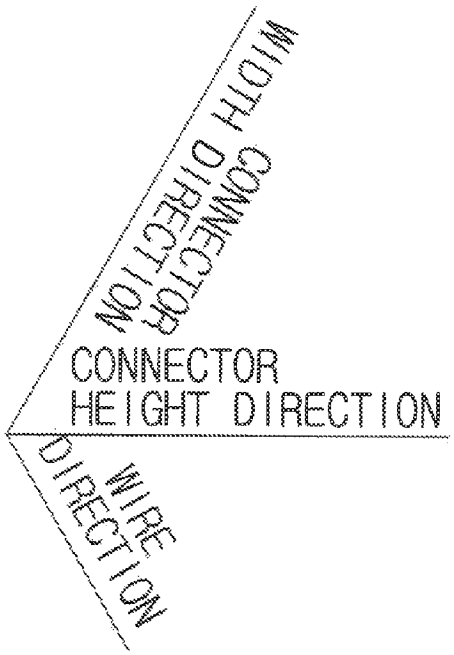
Figure 4:
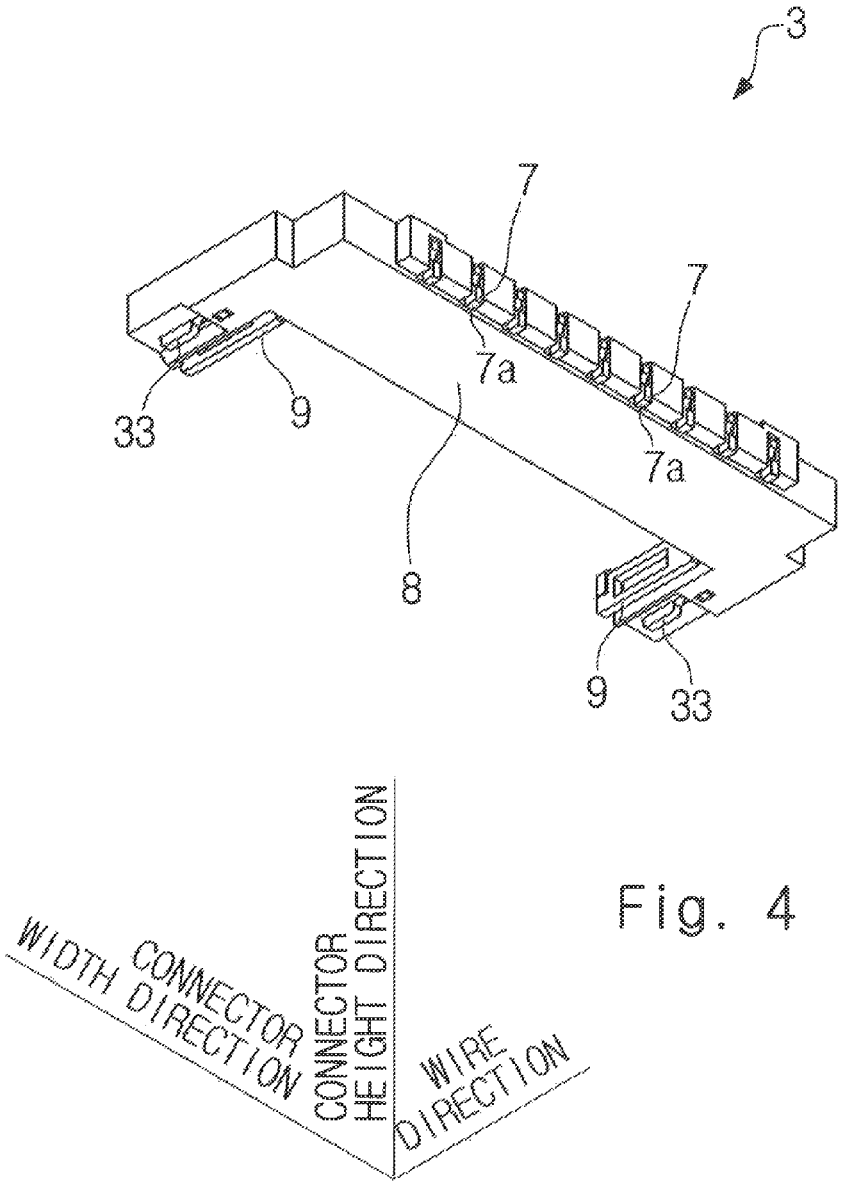
FIG. 4 is a perspective view of the receptacle connector when viewed from another angle (first embodiment)

As shown in FIGS. 3 and 4, the receptacle connector 3 includes the plurality of receptacle contacts 7, the receptacle housing 8 which holds the plurality of receptacle contacts 7, and the pair of assistant fittings 9, as described above.

Figure 5:
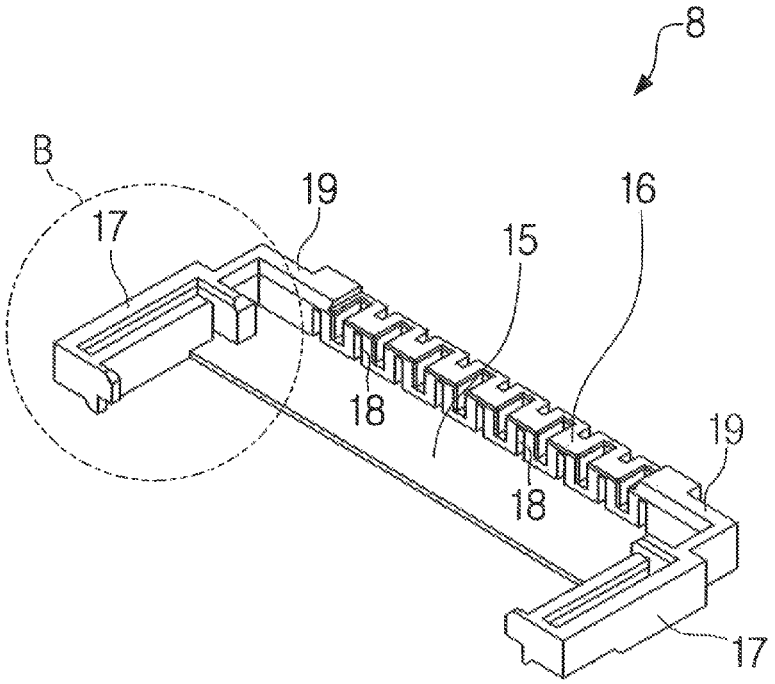
FIG. 5 is a perspective view of a receptacle housing (first embodiment)
Figure 5:
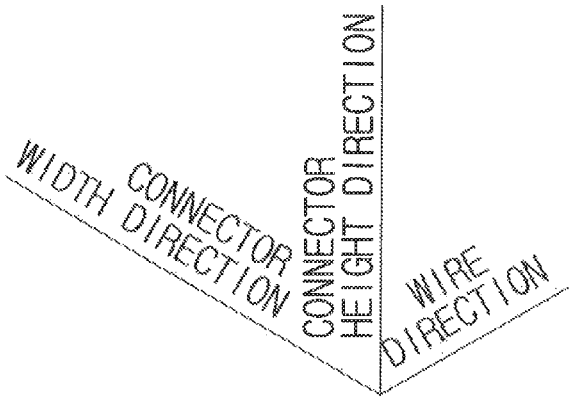
Figure 6:
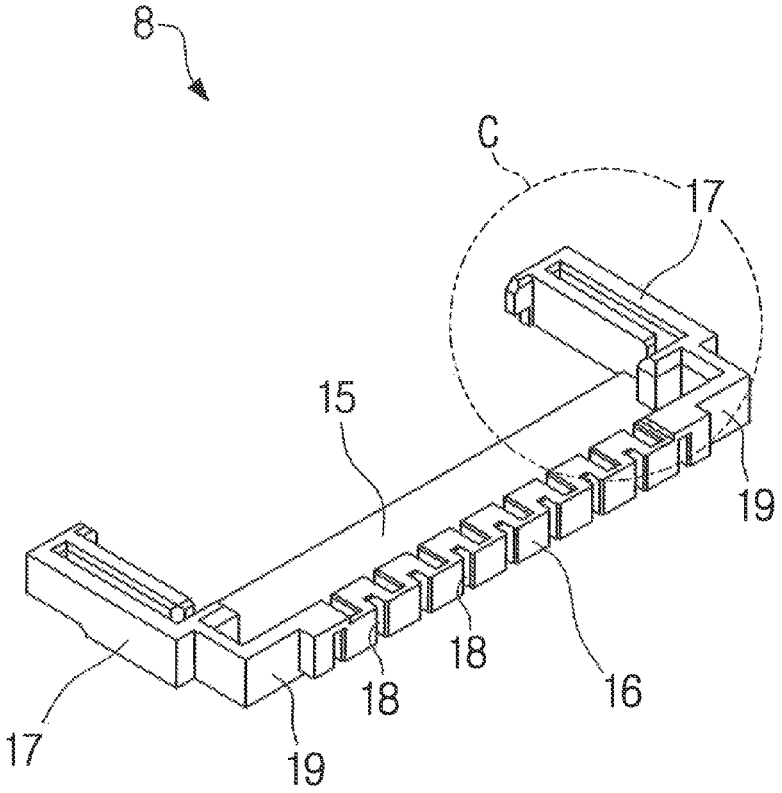
FIG. 6 is a perspective view of the receptacle housing when viewed from another angle (first embodiment)
Figure 6:
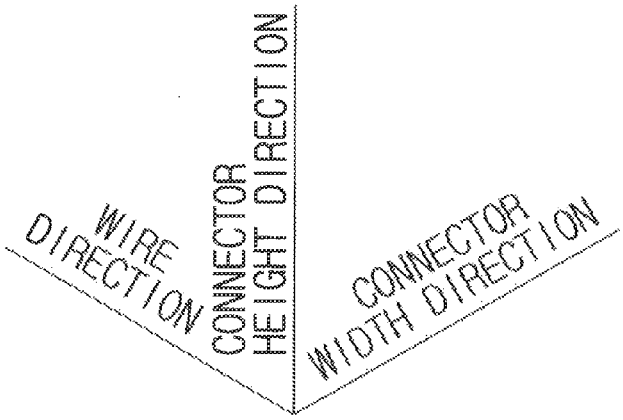
Figure 7:
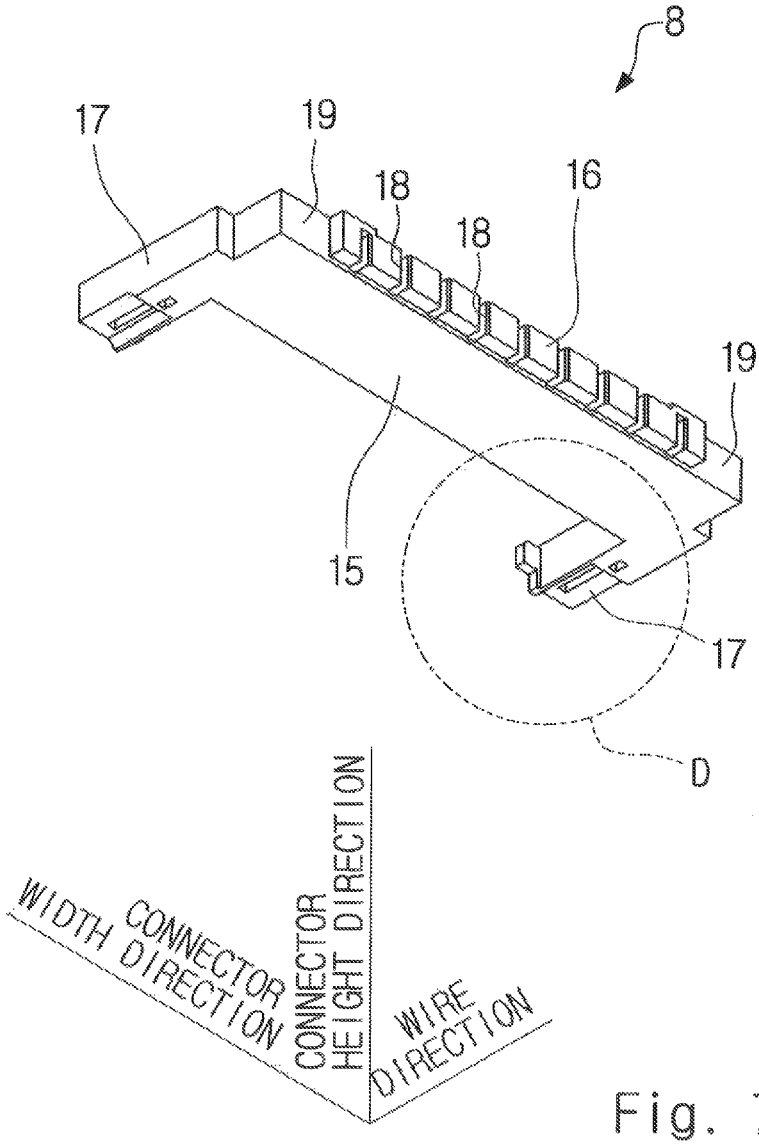
FIG. 7 is a perspective view of the receptacle housing viewed from yet another angle (first embodiment)

As shown in FIGS. 5 to 7, the receptacle housing 8 includes a board opposing portion 15, a receptacle contact holding portion 16, and a pair of side portions 17 (lock piece supporting portions). The board opposing portion 15, the receptacle contact holding portion 16, and the pair of side portions 17, which constitute the receptacle housing 8, are integrally formed of a material having an insulating property, such as resin.

The board opposing portion 15 is a flat plate parallel to the connector mounting surface 10*a* of the circuit board 10, and is formed in a rectangular shape elongated in the connector width direction.

The receptacle contact holding portion 16 is a portion that is connected to an end in the wire connector direction of the board opposing portion 15, protrudes in the board separating direction, and extends in an elongated shape in the connector width direction. The receptacle contact holding portion 16 has a plurality of receptacle contact mounting holes 18 formed therein. Each receptacle contact mounting hole 18 is a hole for attaching each receptacle contact 7 to the receptacle housing 8. The plurality of receptacle contact mounting holes 18 are formed at a predetermined interval along the connector width direction. The plurality of receptacle contact mounting holes 18 are formed between both ends 19 in the connector width direction of the receptacle contact holding portion 16. Each receptacle contact mounting hole 18 is formed so as to penetrate the receptacle contact holding portion 16 in the wire direction. That is, each receptacle contact mounting hole 18 is formed so as to be opened in the wire connector direction and the connector wire direction. The both ends 19 are walls orthogonal to the wire direction.

The pair of side portions 17 are respectively connected to the both ends in the connector width direction of the board opposing portion 15 and the receptacle contact holding portion 16, and are formed so as to protrude in the connector wire direction. The pair of side portions 17 is formed to be elongated along the wire direction. The pair of side portions 17 is formed in a symmetrical shape with respect to the center in the connector width direction of the wire-to-board connector 1. Accordingly, only one of the pair will be described, and the description of the other one of the pair will be omitted.

Figure 8:
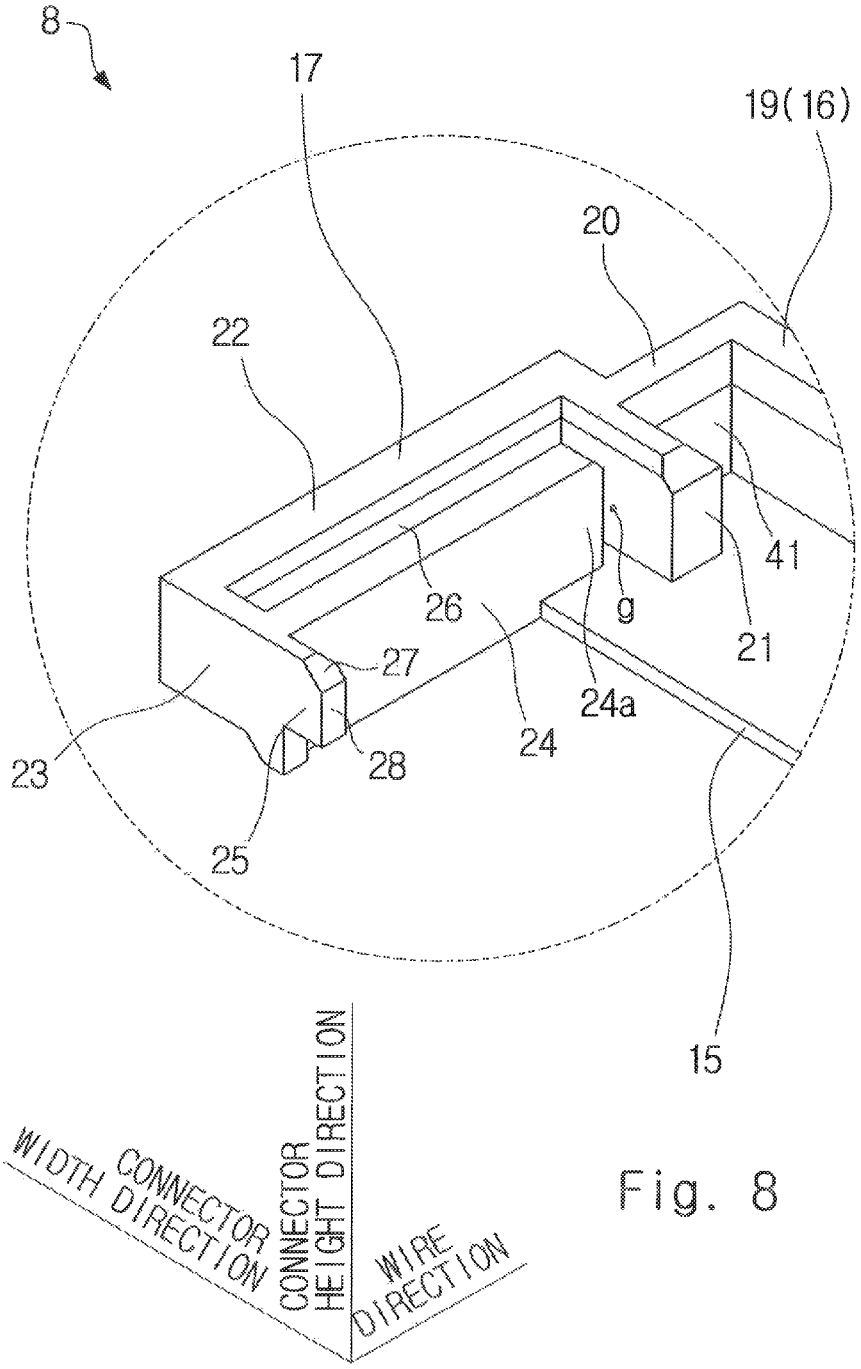
FIG. 8 is an enlarged view of a portion "B" shown in FIG. 5 (first embodiment)
Figure 9:
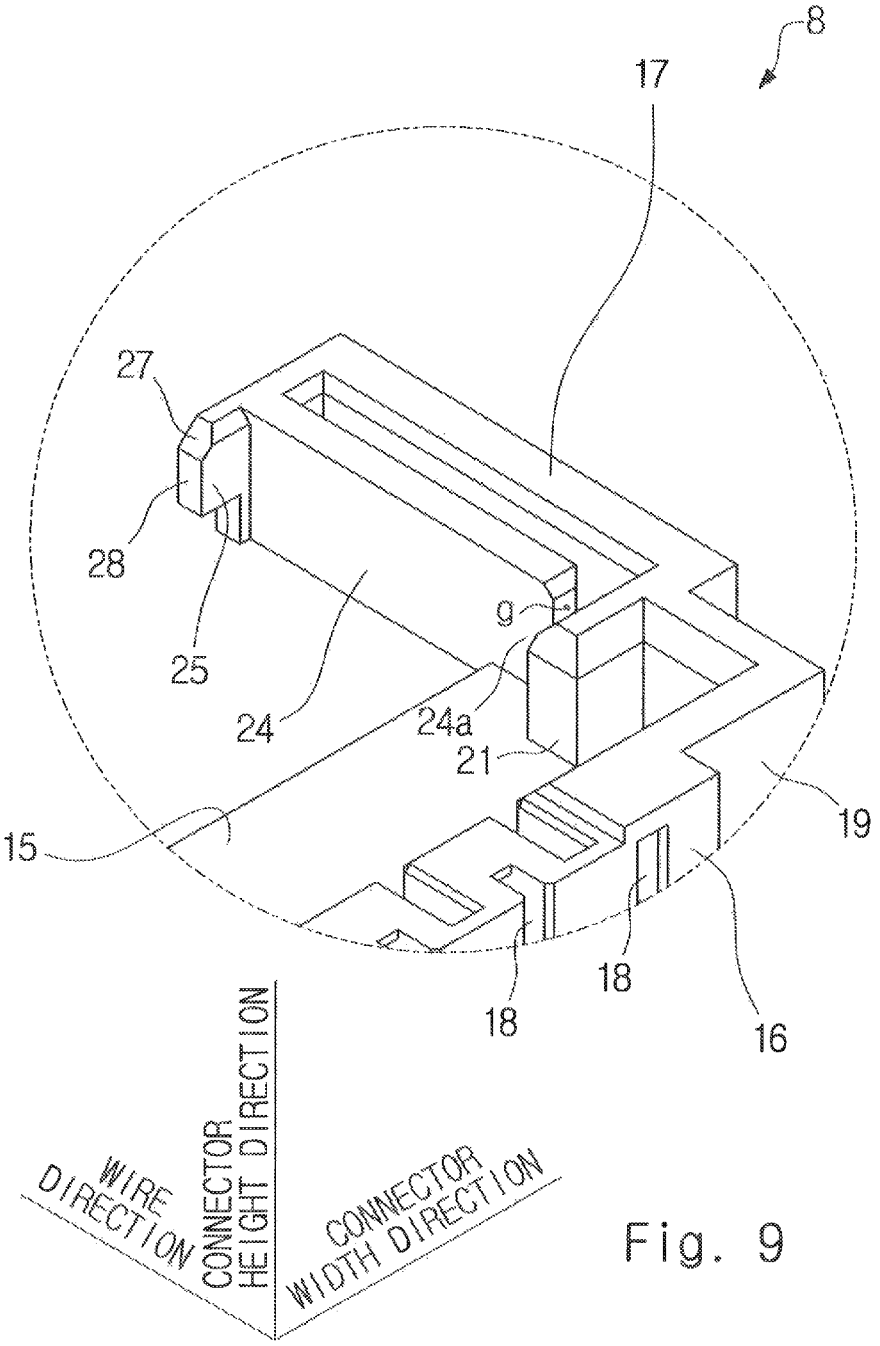
FIG. 9 is an enlarged view of a portion "C" shown in FIG. 6 (first embodiment)
Figure 10:
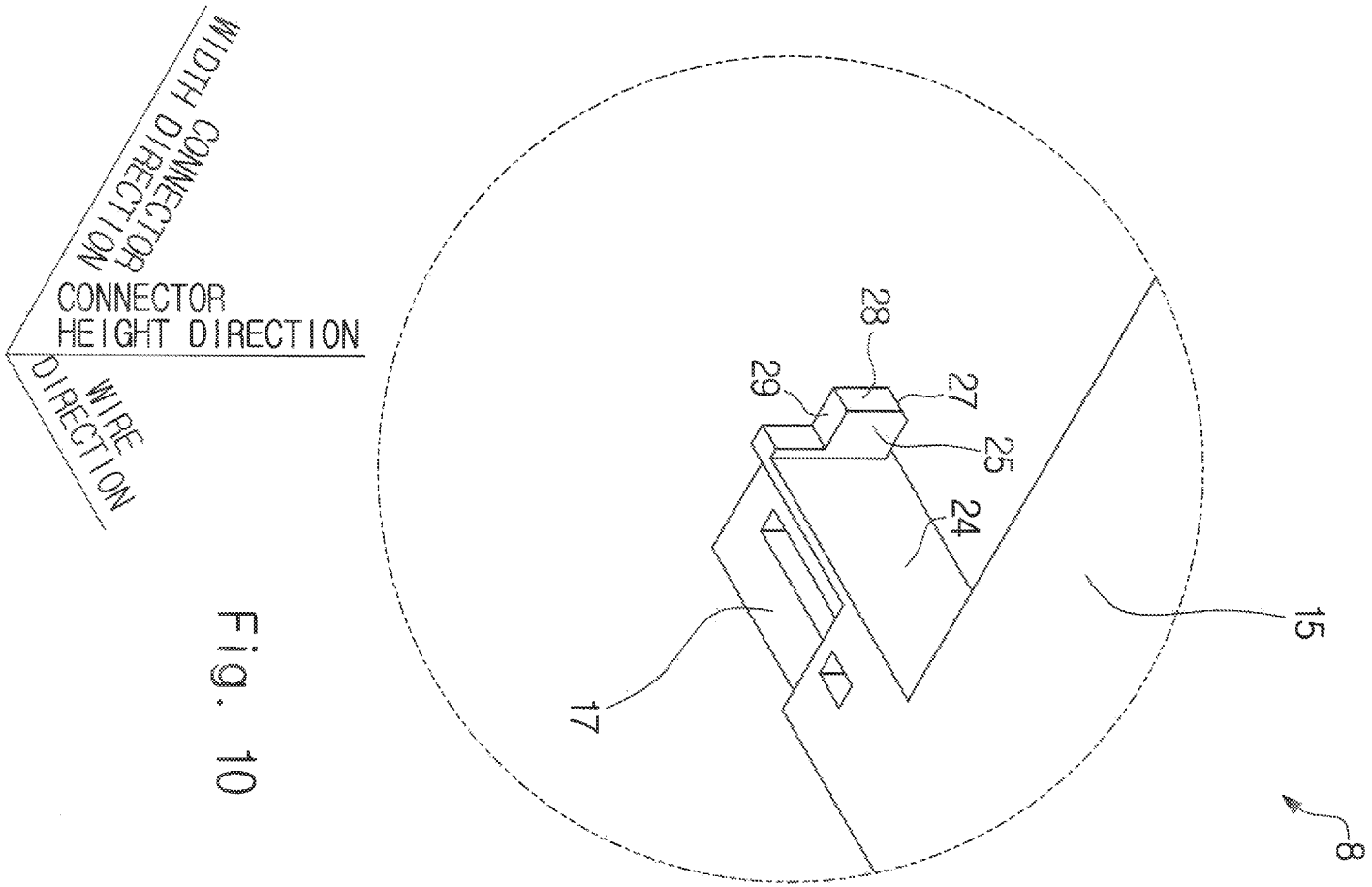
FIG. 10 is an enlarged view of a portion "D" shown in FIG. 7 (first embodiment)

As shown in FIGS. 8 to 10, the side portion 17 includes a positioning groove side partition wall portion 20, a positioning groove front partition wall portion 21, a press-fit groove side partition wall portion 22, a press-fit groove front partition wall portion 23, a press-fit groove inner partition wall portion 24, and a displacement regulating portion 25.

The positioning groove side partition wall portion 20 is a wall that is connected to an end in the connector width anti-center direction at the corresponding end 19 of the receptacle contact holding portion 16, and extends in the connector wire direction. The positioning groove side partition wall portion 20 is orthogonal to the connector width direction.

The positioning groove front partition wall portion 21 is a wall that is connected to an end in the connector wire direction of the positioning groove side partition wall portion 20, and extends in the connector width center direction. The positioning groove front partition wall portion 21 is orthogonal to the wire direction.

The end 19 of the receptacle contact holding portion 16, and the positioning groove side partition wall portion 20 and the positioning groove front partition wall portion 21 of the side portion 17 constitute a positioning groove 41. The end 19 of the receptacle contact holding portion 16 defines a space in the wire connector direction of the positioning groove 41. The positioning groove side partition wall portion 20 defines a space in the connector width anti-center direction of the positioning groove 41. The positioning groove front partition wall portion 21 defines a space in the connector wire direction of the positioning groove 41.

The press-fit groove side partition wall portion 22 is a wall that is connected to an end in the connector width anti-center direction of the positioning groove front partition wall portion 21, and extends in the connector wire direction. The press-fit groove side partition wall portion 22 is orthogonal to the connector width direction.

The press-fit groove front partition wall portion 23 is a wall that is connected to an end in the connector wire direction of the press-fit groove side partition wall portion 22, and extends in the connector width center direction. The press-fit groove front partition wall portion 23 is orthogonal to the wire direction.

The press-fit groove inner partition wall portion 24 is a wall that is connected to an end in the connector width center direction of the press-fit groove front partition wall portion 23, and extends in the wire connector direction. The press-fit groove inner partition wall portion 24 is orthogonal to the connector width direction.

The press-fit groove side partition wall portion 22 and the press-fit groove inner partition wall portion 24 constitute a press-fit groove 26. The press-fit groove side partition wall portion 22 defines a space in the connector width anti-center direction of the press-fit groove 26. The press-fit groove inner partition wall portion 24 defines a space in the connector width center direction of the press-fit groove 26. The press-fit groove front partition wall portion 23 defines a space in the connector wire direction of the press-fit groove 26. The press-fit groove 26 is opened in the board separating direction. The press-fit groove 26 is formed to be elongated along the wire direction.

An end 24*a* in the wire connector direction of the press-fit groove inner partition wall portion 24 is opposed to the positioning groove front partition wall portion 21. A gap "g" is formed between the end 24*a* of the press-fit groove inner partition wall portion 24 and the positioning groove front partition wall portion 21.

The displacement regulating portion 25 is connected to an end in the connector wire direction of the press-fit groove inner partition wall portion 24, and is formed so as to protrude in the connector width center direction. As shown in FIGS. 8 to 10, the displacement regulating portion 25 is connected to a side in the board separating direction of the end in the connector wire direction of the press-fit groove inner partition wall portion 24. The displacement regulating portion 25 includes an inclined guide surface 27, an erect guide surface 28, and a regulating surface 29. The inclined guide surface 27 is a flat surface that is inclined in the board approaching direction toward the connector width center direction on a side in the board separating direction of an end in the connector width center direction of the displacement regulating portion 25. The erect guide surface 28 is a surface that is connected to an edge in the board approaching direction of the inclined guide surface 27 and is orthogonal to the connector width direction. The regulating surface 29 is a surface that is connected to an edge in the board approaching direction of the erect guide surface 28 and is orthogonal to the connector height direction.

The pair of assistant fittings 9 is formed in a symmetrical shape with respect to the center in the connector width direction of the wire-to-board connector 1. Accordingly, only one of the pair will be described, and the description of the other one of the pair will be omitted.

Figure 11:
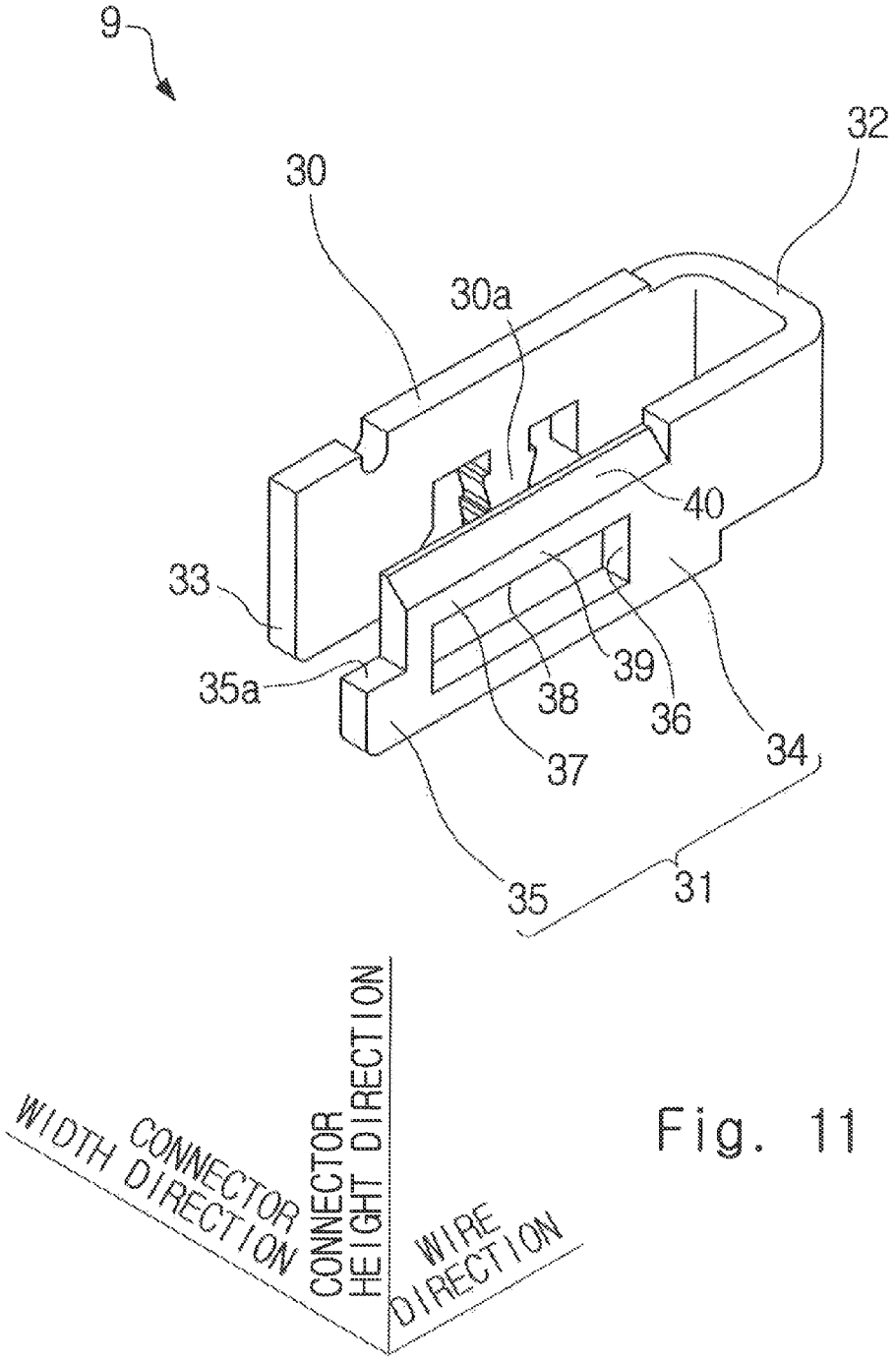
FIG. 11 is a perspective view showing an assistant fitting (first embodiment)

As shown in FIGS. 11 and 12, the assistant fitting 9 includes a lock piece held portion 30, a lock piece opposing portion 31, and a lock piece coupling portion 32. The assistant fitting 9 is formed by sheet metal bending.

The lock piece held portion 30 is a portion held by the receptacle housing 8. The lock piece held portion 30 is formed so as to extend in the wire direction. The lock piece held portion 30 is orthogonal to the connector width direction. The lock piece held portion 30 includes a press-fitted portion 30*a* and a soldered leg portion 33. The press-fitted portion 30*a* is formed in a rod shape protruding in the board approaching direction. The soldered leg portion 33 is a portion that is soldered to the connector mounting surface 10*a* of the circuit board 10.

The lock piece opposing portion 31 is formed so as to extend in the wire direction. The lock piece opposing portion 31 is orthogonal to the connector width direction. The lock piece opposing portion 31 includes an opposing portion body 34 and a regulated projection 35.

The opposing portion body 34 is formed to be elongated in the wire direction. The opposing portion body 34 is orthogonal to the connector width direction. The opposing portion body 34 has a lock hole 36 which is formed in a substantially rectangular shape when viewed along the connector width anti-center direction. The lock hole 36 is formed to be elongated in the wire direction. Since the lock hole 36 is formed, a lock beam 37 which defines a space in the board separating direction of the lock hole 36 is formed on a side in the board separating direction of the lock hole 36. The lock beam 37 includes a receptacle lock surface 38, a plug opposing surface 39, and an assembly guide surface 40. The receptacle lock surface 38 is a surface that faces in the direction approaching the connector mounting surface 10*a* of the circuit board 10. The receptacle lock surface 38 is a flat surface that faces in the board approaching direction. The receptacle lock surface 38 is orthogonal to the connector height direction. The receptacle lock surface 38 is formed to be elongated in the wire direction. The plug opposing surface 39 is a flat surface that is connected to an edge in the connector width center direction of the receptacle lock surface 38 and faces in the connector width center direction. The plug opposing surface 39 is orthogonal to the connector width direction. The assembly guide surface 40 is a flat surface that is connected to an edge in the board separating direction of the plug opposing surface 39 and is inclined in the connector width center direction toward the board approaching direction.

The regulated projection 35 is a portion that is connected to a side in the board approaching direction of an end in the connector wire direction of the opposing portion body 34 and is formed so as to protrude in the connector wire direction. The regulated projection 35 includes a regulated surface 35*a* that faces in the board separating direction. The regulated surface 35*a* is orthogonal to the connector height direction.

The lock piece coupling portion 32 is a portion that couples an end in the wire connector direction of the lock piece held portion 30 with an end in the wire connector direction of the lock piece opposing portion 31. The lock piece coupling portion 32 is connected to an end in the wire connector direction of the lock piece held portion 30, and is formed so as to extend in the connector width center direction. The lock piece coupling portion 32 is orthogonal to the wire direction. An end in the connector width center direction of the lock piece coupling portion 32 is connected to an end in the wire connector direction of the lock piece opposing portion 31.

The assistant fitting 9 includes the lock piece held portion 30, the lock piece opposing portion 31, and the lock piece coupling portion 32, thereby forming a U-shape when viewed along the board approaching direction.

(Assembly of the Receptacle Connector 3)

Next, a method for assembling the receptacle connector 3 will be described in detail.

First, as shown in FIGS. 3 to 7, the plurality of receptacle contacts 7 are respectively press-fitted into the receptacle contact mounting holes 17 of the receptacle contact holding portion 16 of the receptacle housing 8. A direction in which the receptacle contacts 7 are respectively press-fitted into the receptacle contact mounting holes 18 corresponds to the connector wire direction. Each receptacle contact 7 is partially exposed in the connector wire direction as shown in FIG. 3 and is partially exposed in the board approaching direction as shown in FIG. 4 in the state where each receptacle contact 7 is attached to the receptacle housing 8.

Figure 14:
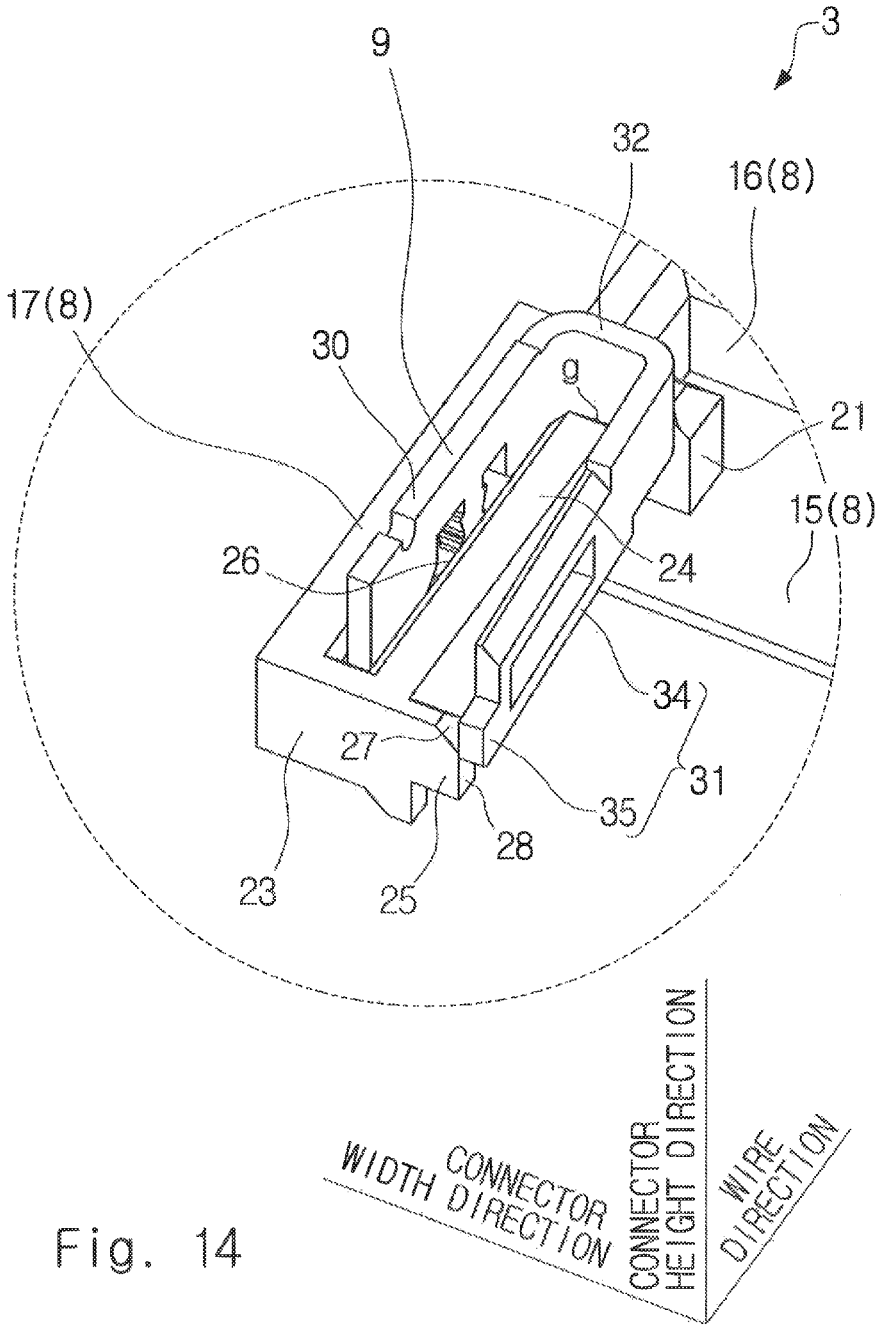
FIG. 14 is an enlarged view of a portion "E" shown in FIG. 13 (first embodiment)

Next, as shown in FIG. 13, the pair of assistant fittings 9 are respectively attached to the pair of side portions 17 of the receptacle housing 8. Specifically, the assistant fittings 9 are first positioned relative to the respective side portions 17 in such a manner that the lock piece held portion 30 of each assistant fitting 9 shown in FIG. 14 is inserted into the press-fit groove 26 of the corresponding side portion 17 of the receptacle housing 8 and the lock piece coupling portion 32 of each assistant fitting 9 is inserted into the gap "g" of the corresponding side portion 17 of the receptacle housing 8. After the assistant fittings 9 are positioned relative to the respective side portions 17, the assistant fittings 9 are pushed in the board approaching direction.

Then, the lock piece held portion 30 of each assistant fitting 9 is inserted into the press-fit groove 26 of the corresponding side portion 17 of the receptacle housing 8. At this time, the press-fitted portion 30*a* (also see FIGS. 11 and 12) of the lock piece held portion 30 of each assistant fitting 9 is press-fit into a press-fit hole which is not shown and is formed in the press-fit groove 26 of each side portion 17 of the receptacle housing 8. The lock piece coupling portion 32 of each assistant fitting 9 is inserted into the gap "g" of the corresponding side portion 17 of the receptacle housing 8.

The regulated projection 35 of the lock piece opposing portion 31 of each assistant fitting 9 passes over the inclined guide surface 27 of the displacement regulating portion 25 of the corresponding side portion 17 of the receptacle housing 8 in the connector width center direction, while the opposing portion body 34 of the lock piece opposing portion 31 is elastically displaced in the connector width center direction. Then, the regulated projection 35 slides on the erect guide surface 28 of the displacement regulating portion 25 in the board approaching direction.

Figure 15:
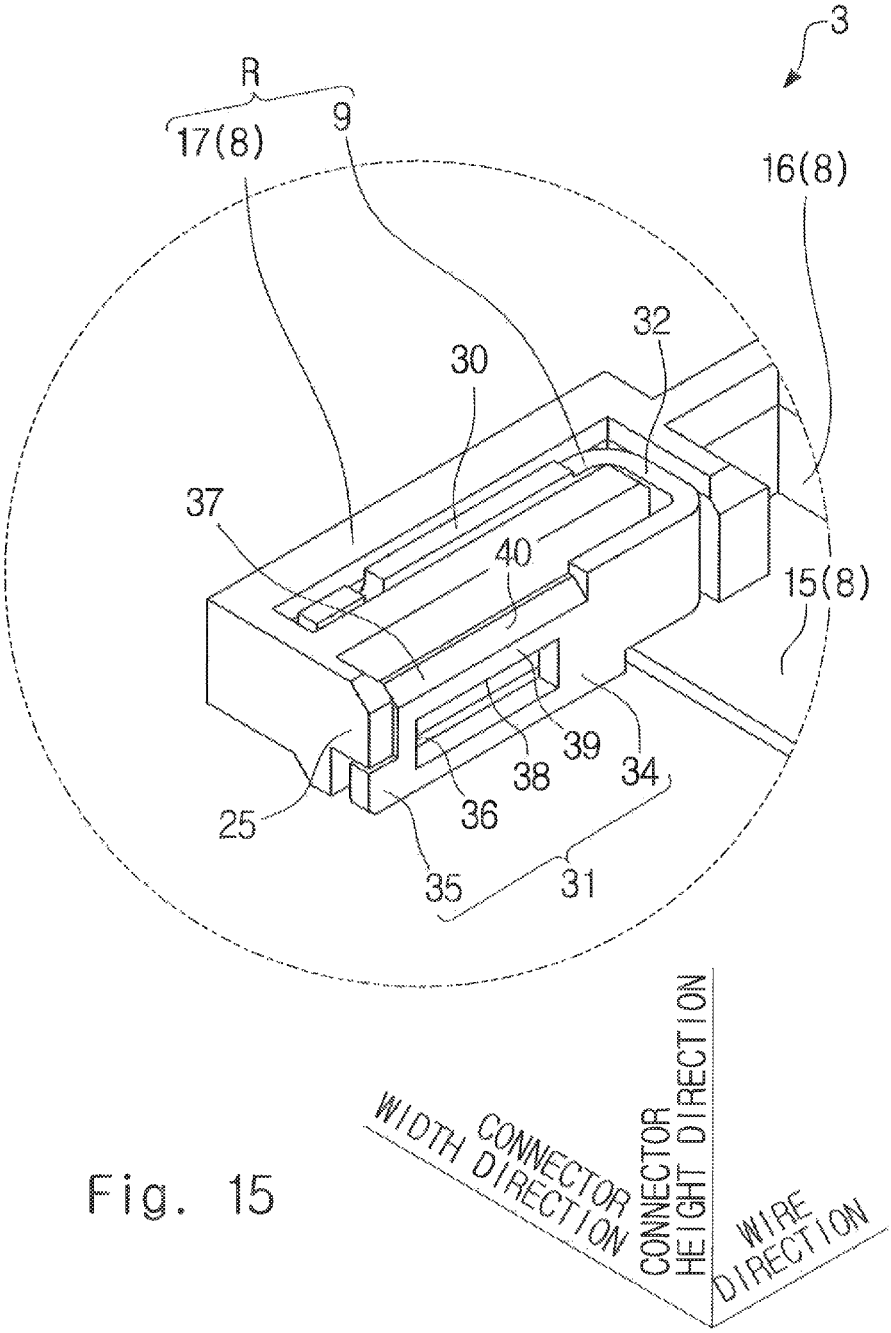
FIG. 15 is an enlarged view of a portion "A" shown in FIG. 3 (first embodiment)

When each assistant fitting 9 is further pushed in the board approaching direction, the regulated projection 35 eventually passes over the displacement regulating portion 25 in the board approaching direction, and is displaced in the connector width anti-center direction as shown in FIG. 15 by the spring restoring force of the assistant fitting 9. FIG. 15 shows a state in which each assistant fitting 9 is attached to the corresponding side portion 17 of the receptacle housing 8. As shown in FIG. 15, each assistant fitting 9 is supported in a cantilever manner by the corresponding side portion 17 of the receptacle housing 8.

In the state shown in FIG. 15, the displacement regulating portion 25 and the regulated projection 35 face each other in the connector height direction. Specifically, the regulating surface 29 of the displacement regulating portion 25 shown in FIG. 10 and the regulated surface 35*a* of the regulated projection 35 shown in FIG. 11 are opposed to each other in the connector height direction. The opposed relationship between the displacement regulating portion 25 and the regulated projection 35 regulates the elastic displacement of the lock piece opposing portion 31 of each assistant fitting 9 shown in FIG. 15 in the board separating direction.

Figure 16:
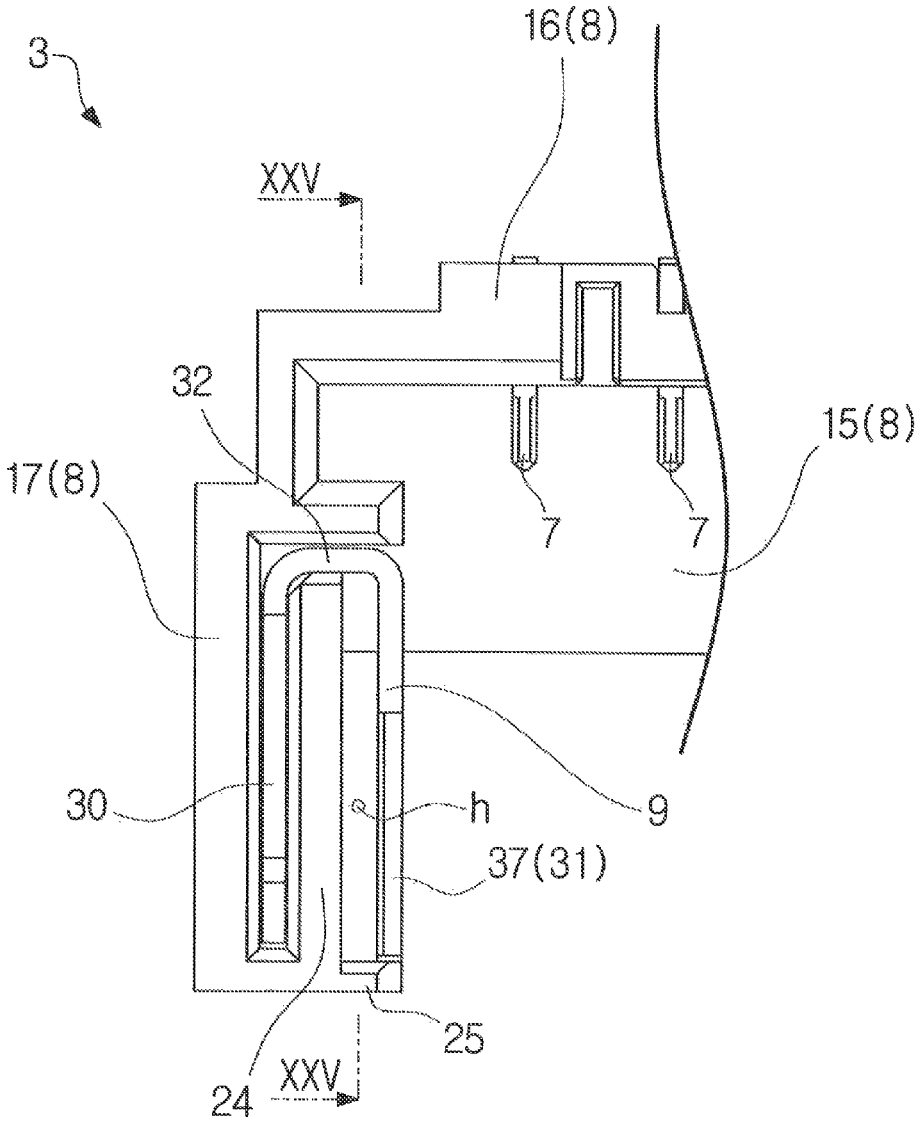
FIG. 16 is a plan view of the receptacle connector (first embodiment)
Figure 16:
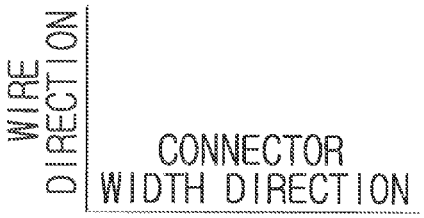

As shown in FIG. 16, a gap "h" is formed between the press-fit groove inner partition wall portion 24 of each side portion 17 and the lock piece opposing portion 31 of each assistant fitting 9 in the state where each assistant fitting 9 is attached to the corresponding side portion 17 of the receptacle housing 8. Accordingly, the lock beam 37 of the lock piece opposing portion 31 of each assistant fitting 9 is elastically displaceable in the connector width anti-center direction.

In this embodiment, "a side surface opposing portion R" corresponds to each side portion 17 and each assistance fitting 9 of the receptacle housing 8 as shown in FIG. 15.

(Plug Connector 2)

Next, the plug connector 2 will be described in detail with reference to FIGS. 17 to 24.

The plug connector 2 shown in FIGS. 17 and 18 includes the plurality of plug contacts 4 and the plug housing 5 that holds the plurality of plug contacts 4, as described above.

The plug housing 5 includes a plug housing body 50, a releasing projection 51, a pair of positioning projections 52, and a pair of claw portions 53.

The plug housing body 50 is a flat body with a small thickness in the connector height direction. The plug housing body 50 has a rectangular shape when viewed along the board approaching direction, and is formed to be elongated in the connector width direction. The plug housing body 50 has a plurality of plug contact mounting holes 54 formed therein. The plurality of plug contact mounting holes 54 are formed at a predetermined interval along the connector width direction. Each plug contact mounting hole 54 is formed so as to penetrate the plug housing body 50 in the wire direction. That is, each plug contact mounting hole 54 is formed so as to be opened in the wire connector direction and the connector wire direction.

The plug housing body 50 includes a pair of plug side surfaces 50*a* serving as a pair of side surfaces of the plug housing body 50. Each of the pair of plug side surfaces 50*a* is a flat surface substantially parallel to both of the wire direction and the connector height direction. That is, each plug side surface 50*a* is substantially orthogonal to the connector width direction. In this embodiment, the pair of plug side surfaces 50*a* is parallel to both of the wire direction and the connector height direction. The pair of plug side surfaces 50*a* is orthogonal to the connector width direction.

FIG. 19 shows the plug contact 4 which is attached to an end of the wire 6. The plug contact 4 includes a pair of contact pieces 4*a* which contact the corresponding receptacle contact 7 so as to sandwich the receptacle contact 7. As shown in FIGS. 17 and 18, the plurality of plug contacts 4 are arranged side by side in the connector width direction. The plurality of plug contacts 4 are sandwiched by the pair of plug side surfaces 50*a* in the connector width direction. In other words, the pair of plug side surfaces 50*a* sandwich the plurality of plug contacts 4 in the connector width direction.

As shown in FIGS. 17 and 18, the releasing projection 51 is connected to a side in the board separating direction of an end in the wire connector direction of the plug housing body 50, and is formed so as to protrude in the wire connector direction. The releasing projection 51 is formed to be elongated in the connector width direction.

The pair of positioning projections 52 is formed in a symmetrical shape with respect to the center in the connector width direction of the wire-to-board connector 1. Accordingly, only one of the pair will be described, and the description of the other one of the pair will be omitted. The positioning projection 52 is connected to an end in the connector width direction of the end in the wire connector direction of the plug housing body 50, and is formed so as to protrude in the connector width anti-center direction.

Figure 20:
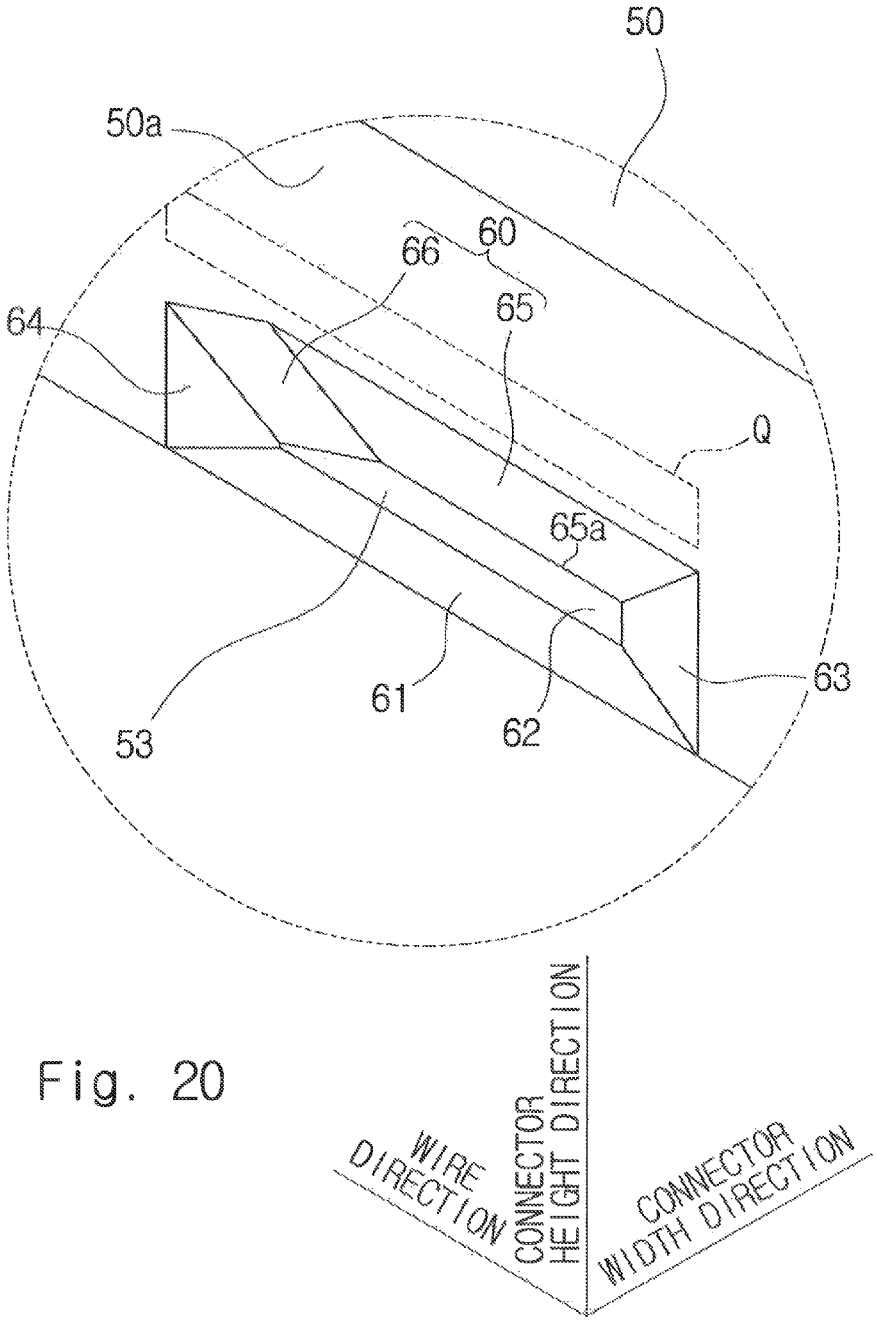
FIG. 20 is an enlarged view of a portion "F" shown in FIG. 17 (first embodiment)

The pair of claw portions 53 is formed in a symmetrical shape with respect to the center in the connector width direction of the wire-to-board connector 1. Accordingly, only one of the pair will be described, and the description of the other one of the pair will be omitted. The claw portion 53 is connected to a side in the connector wire direction of the plug side surface 50*a*, and is formed so as to protrude in the connector width anti-center direction from the plug side surface 50*a*. The claw portion 53 is formed to be elongated in the wire direction. As shown in FIG. 20, the claw portion 53 has a prism shape with a trapezoidal longitudinal sectional shape, and the side in the wire connector direction of the claw portion 53 is partially cut off. The claw portion 53 includes a plug lock surface 60, a mating guide surface 61, a side standing surface 62, an end standing surface 63, and an end inclined surface 64 (inclined surface).

The plug lock surface 60 is a surface that faces in a direction away from the connector mounting surface 10*a* of the circuit board 10 and is elongated in the wire direction. The plug lock surface 60 includes a lock maintaining surface 65 that is disposed on the side in the connector wire direction, and an unlocking surface 66 that is disposed on the side in the wire connector direction. The lock maintaining surface 65 is a flat surface that is connected to the plug side surface 50*a* and is substantially orthogonal to the connector height direction. The unlocking surface 66 is a flat surface that is connected to the plug side surface 50*a*, is inclined in the connector width center direction toward the board separating direction, and is inclined in the connector width center direction toward the wire connector direction. The lock maintaining surface 65 and the unlocking surface 66 are connected to each other. The lock maintaining surface 65 and the unlocking surface 66 are adjacent to each other in the wire direction. The lock maintaining surface 65 is disposed on the side in the connector wire direction when viewed from the unlocking surface 66. That is, the unlocking surface 66 is disposed on the side in the wire connector direction when viewed from the lock maintaining surface 65. The unlocking surface 66 is connected to an edge 65*a* on a side far from the plug side surface 50*a* of the lock maintaining surface 65. In other words, the unlocking surface 66 is connected to the edge 65*a* on a side in the connector width anti-center direction of the lock maintaining surface 65.

The mating guide surface 61 is a flat surface that faces in the direction approaching the connector mounting surface 10*a* of the circuit board 10 and is elongated in the wire direction. The mating guide surface 61 is inclined in the connector width center direction toward the board approaching direction.

The side standing surface 62 is a flat surface that faces in the connector width anti-center direction and is elongated in the wire direction. The side standing surface 62 is orthogonal to the connector width direction. The side standing surface 62 is connected to the plug lock surface 60 and the mating guide surface 61. The side standing surface 62 is formed between the plug lock surface 60 and the mating guide surface 61.

The end standing surface 63 is a flat surface that is connected to the plug side surface 50*a* and faces in the connector wire direction. The end standing surface 63 is orthogonal to the wire direction. The end standing surface 63 is connected to each of the plug lock surface 60, the mating guide surface 61, and the side standing surface 62.

The end inclined surface 64 is a flat surface that is connected to the plug side surface 50*a* and faces in the wire connector direction and the connector width anti-center direction. The end inclined surface 64 is inclined in the connector width center direction toward the wire connector direction. The end inclined surface 64 is connected each of the unlocking surface 66 of the plug lock surface 60, the mating guide surface 61, and the side standing surface 62.

The plug side surface 50*a* has a reference plane Q as indicated by an alternate long and two short dashes line in FIG. 20. The reference plane Q is a part of the plug side surface 50*a*. The reference plane Q is a portion of the plug side surface 50*a* which is located on a side farther from the connector mounting surface 10*a* of the circuit board 10 than the claw portion 53. The reference plane Q is a portion of the plug side surface 50*a* which is located on the side in the board separating direction relative to the claw portion 53.

Figure 21:
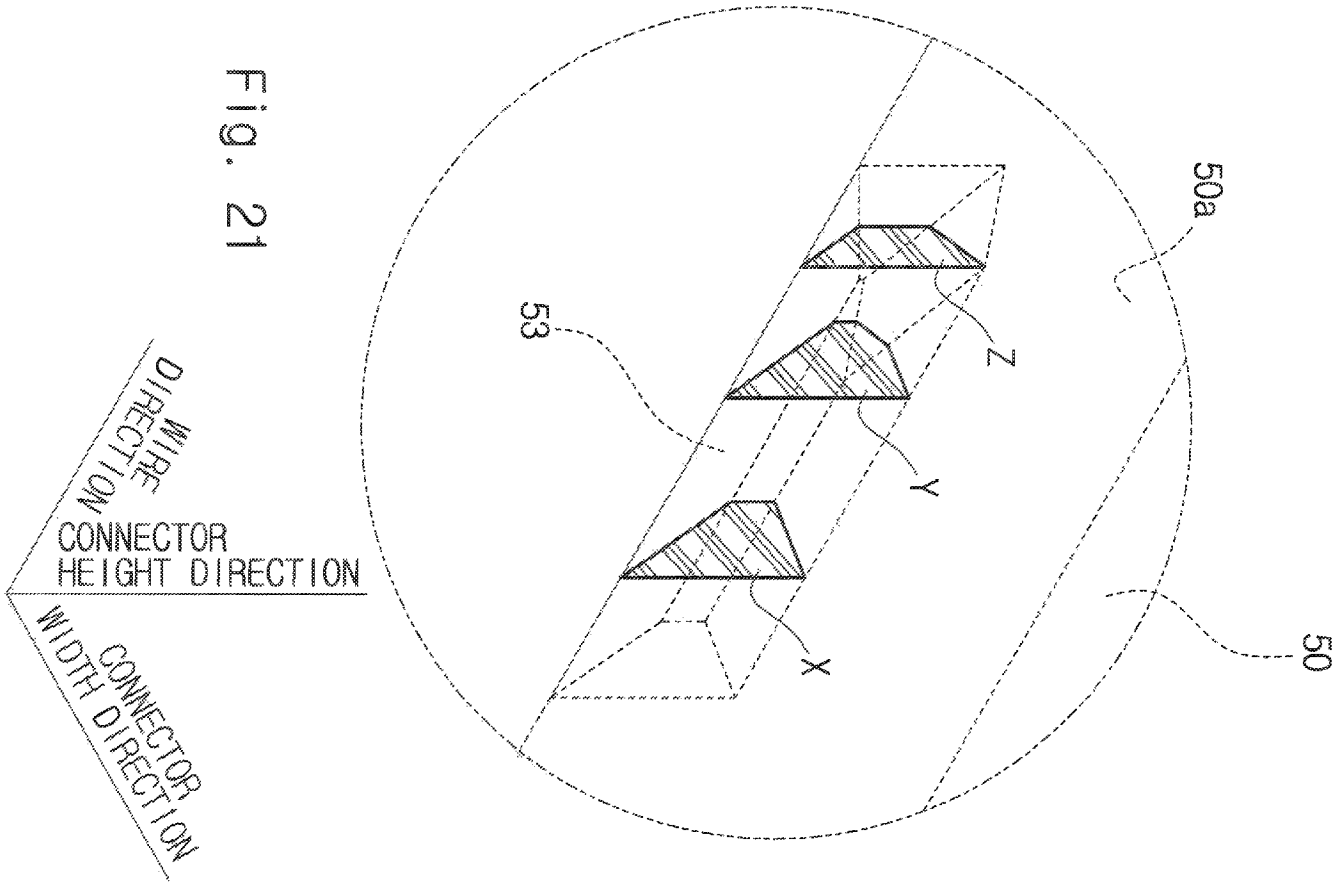
FIG. 21 is an image of a sectional view of a claw portion (first embodiment)

FIG. 21 shows three cross-sections, i.e., a cross-section X, a cross-section Y, and a cross-section Z, of the claw portion 53. The cross-section X is located on the side in the connector wire direction relative to the cross-section Y. The cross-section Y is located on the side in the connector wire direction relative to the cross-section Z. The cross-section X, the cross-section Y, and the cross-section Z are cross-sections orthogonal to the wire direction. The shape of the claw portion 53 will be described in more detail by using the cross-section X, the cross-section Y, and the cross-section Z.

Figure 22:
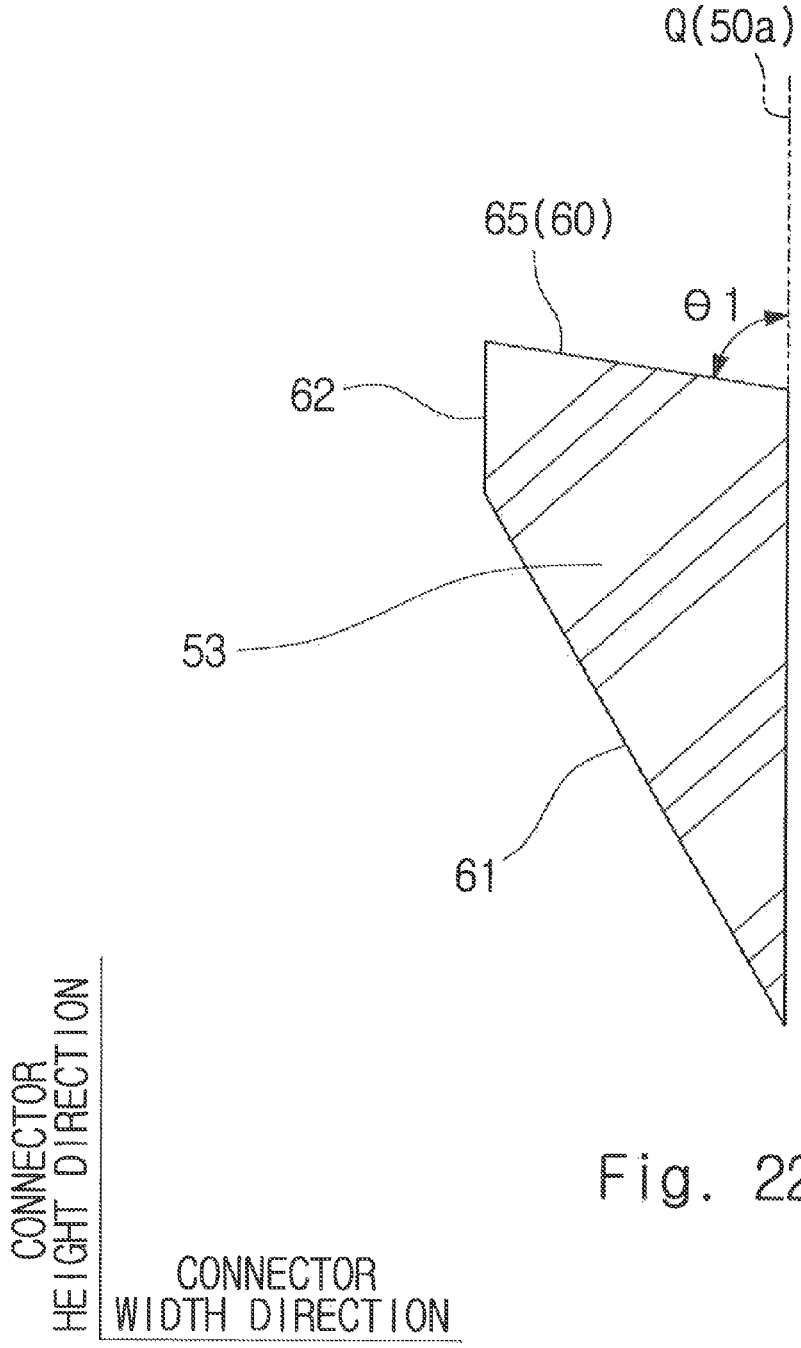
FIG. 22 is a cross-section X of the claw portion specified in FIG. 21 (first embodiment)

In the cross-section X shown in FIG. 22, only the lock maintaining surface 65 of the plug lock surface 60 appears. In the cross-section Y shown in FIG. 23, both of the lock maintaining surface 65 and the unlocking surface 66 of the plug lock surface 60 appear. In other words, in the cross-section Y, the lock maintaining surface 65 and the unlocking surface 66 are adjacent to each other in the connector width direction. In the cross-section Z shown in FIG. 24, only the unlocking surface 66 of the plug lock surface 60 appears. In the cross-section X shown in FIG. 22 and the cross-section Y shown in FIG. 23, the side standing surface 62 appears. On the other hand, in the cross-section Z shown in FIG. 24, the end inclined surface 64 appears instead of the side standing surface 62.

Figure 23:
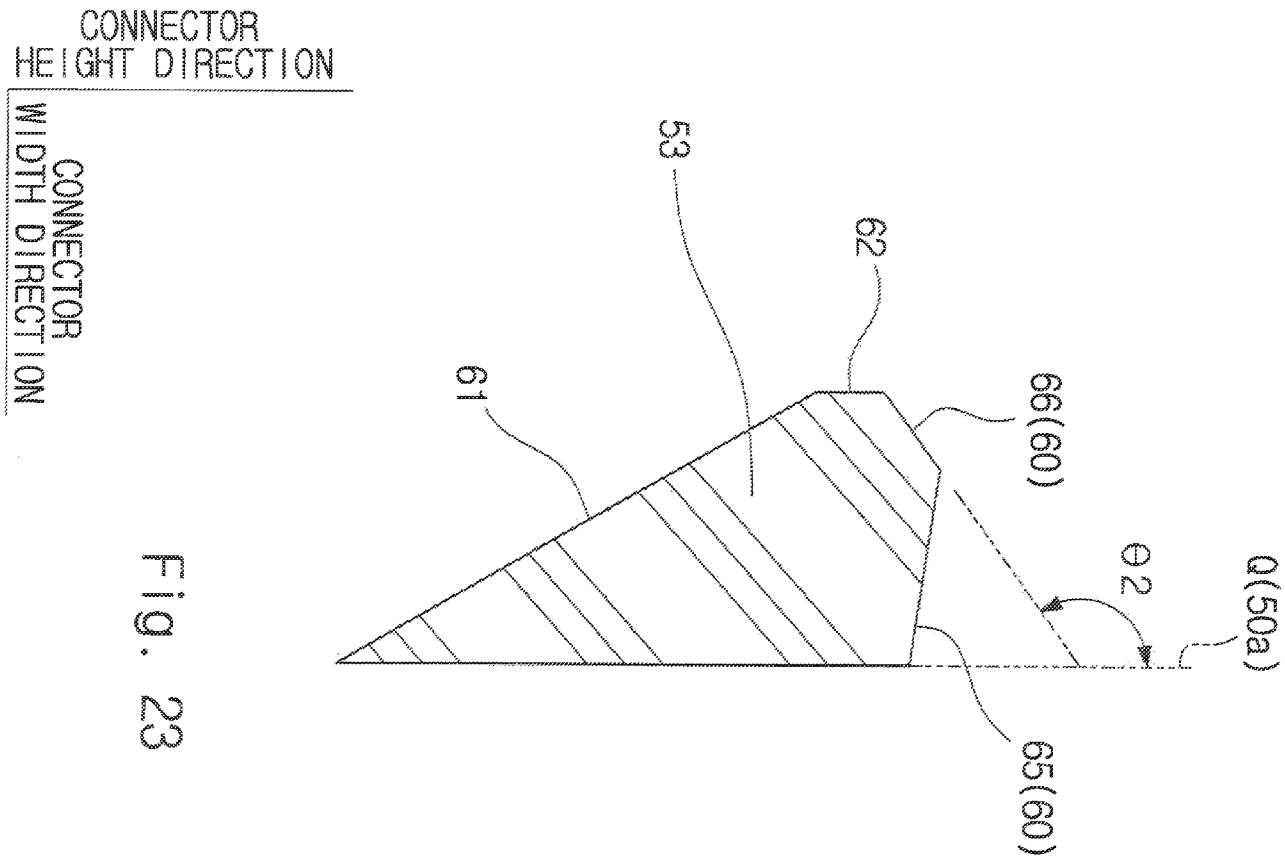
FIG. 23 is a cross-section Y of the claw portion specified in FIG. 21 (first embodiment)
Figure 24:
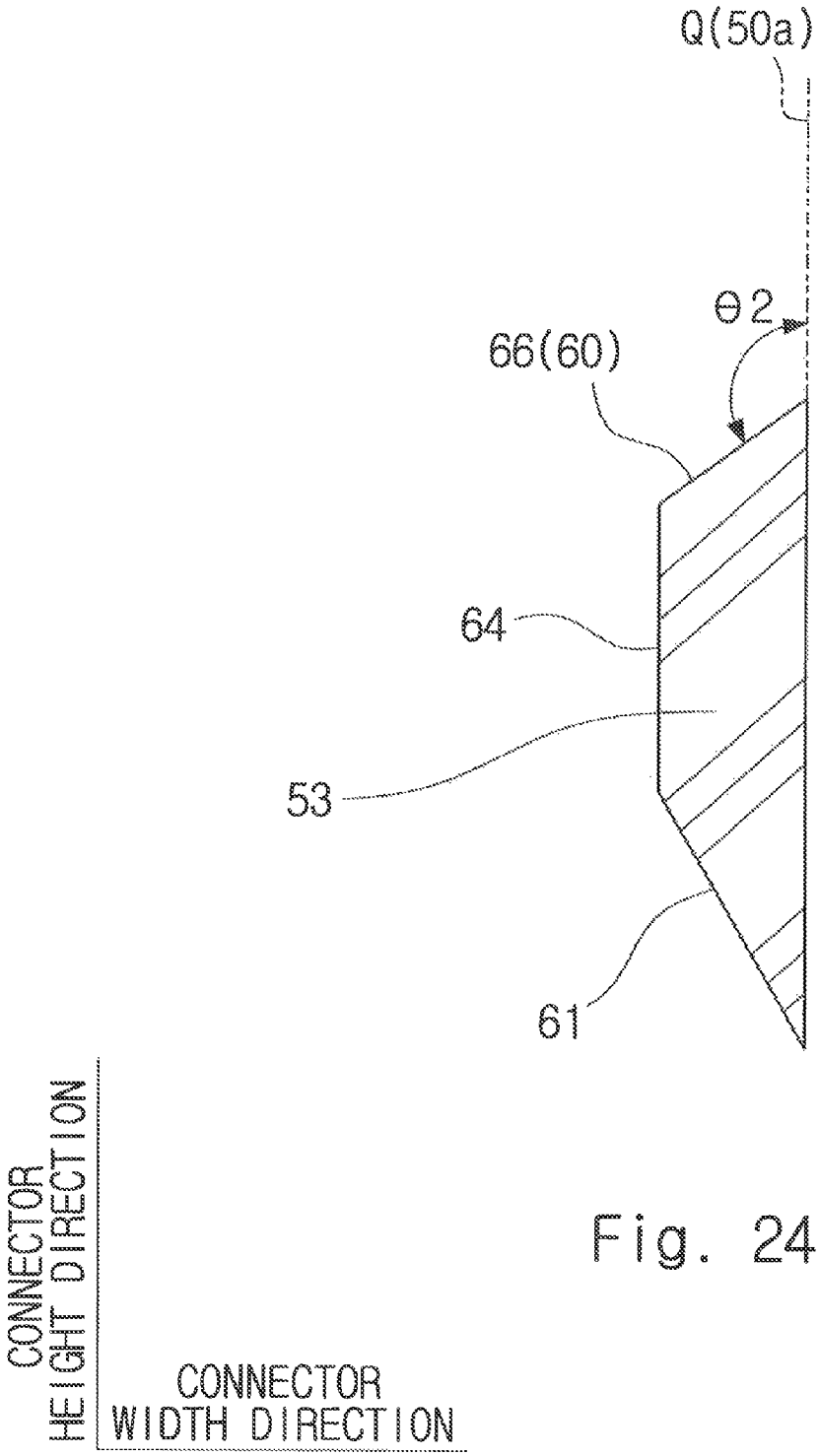
FIG. 24 is a cross-section Z of the claw portion specified in FIG. 21 (first embodiment)

As shown in FIG. 22, an angle formed between the reference plane Q and the lock maintaining surface 65 is defined as a lock maintaining angle θ1. As shown in FIGS. 23 and 24, an angle formed between the reference plane Q and the unlocking surface 66 is defined as an unlocking angle θ2. In this embodiment, the lock maintaining angle θ1 is smaller than the unlocking angle θ2. Specifically, the lock maintaining angle θ1 is equal to or smaller than 90 degrees. Preferably, the lock maintaining angle θ1 ranges from 70 to 90 degrees. More preferably, the lock maintaining angle θ1 ranges from 80 to 85 degrees. In this embodiment, the lock maintaining angle θ1 is 85 degrees, and the unlocking angle θ2 is greater than 90 degrees. Preferably, the unlocking angle θ2 ranges from 95 to 165 degrees. More preferably, the unlocking angle θ2 ranges from 120 to 150 degrees. In this embodiment, the unlocking angle θ2 is 135 degrees.

(Assembly of the Plug Connector 2)

Next, a method for assembling the plug connector 2 will be described. To assemble the plug connector 2, each plug contact 4 is attached to an end of the corresponding wire 6 as shown in FIG. 19, and each plug contact 4 is inserted into the corresponding plug contact mounting hole 54 of the plug housing body 50 of the plug housing 5 in the wire connector direction as shown in FIG. 17. As a result, due to an operation of a lance, which is not shown, each plug contact 4 is inhibited from being disengaged from the corresponding plug contact mounting hole 54.

(Method for Mating the Wire-to-Board Connector 1)

Next, a method for mating the wire-to-board connector 1 will be described. To mate the plug connector 2 with the receptacle connector 3, the receptacle connector 3 is preliminarily mounted on the connector mounting surface 10*a* of the circuit board 10 as shown in FIG. 2. Specifically, the soldered leg portion 33 (also see FIG. 4) of the lock piece held portion 30 of each assistant fitting 9 shown in FIG. 11 is soldered to the connector mounting surface 10*a* (also see FIG. 2) of the circuit board 10. Further, a soldered leg portion 7*a* of each receptacle contact 7 shown in FIG. 4 is soldered to the connector mounting surface 10*a* (also see FIG. 2) of the circuit board 10.

Next, as shown in FIG. 2, the plug connector 2 is caused to descend in the mating direction P toward the receptacle connector 3. Then, the plug connector 2 and the receptacle 3 behave in the following manner.

(1) The pair of positioning projections 52 of the plug housing 5 shown in FIGS. 17 and 18 are respectively inserted into the pair of positioning grooves 41 shown in FIGS. 3 and 8. As a result, the position of the plug connector 2 relative to the receptacle connector 3 is adjusted. In other words, the pair of positioning projections 52 and the pair of positioning grooves 41 exert the effect of positioning the plug connector 2 relative to the receptacle connector 3. Specifically, the effect of positioning the plug connector 2 relative to the receptacle connector 3 means the effect of positioning the plug connector 2 relative to the receptacle connector 3 in a direction parallel to the connector mounting surface 10*a* of the circuit board 10. After the mating of the wire-to-board connector 1, the pair of positioning projections 52 and the pair of positioning grooves 41 exert the retaining effect that inhibits the plug connector 2 from being disengaged from the receptacle 3 when the wires 6 are pulled in the connector wire direction.

(2) As shown in FIG. 18, each receptacle contact 7 shown in FIG. 3 is inserted between the pair of contact pieces 4*a* (also see FIG. 19) which are held by the plug housing 5 of the plug connector 2. This allows the pair of contact pieces 4*a* of each plug contact 4 to reliably contact the corresponding receptacle contact 7 so as to sandwich the receptacle contact 7.

Figure 25:
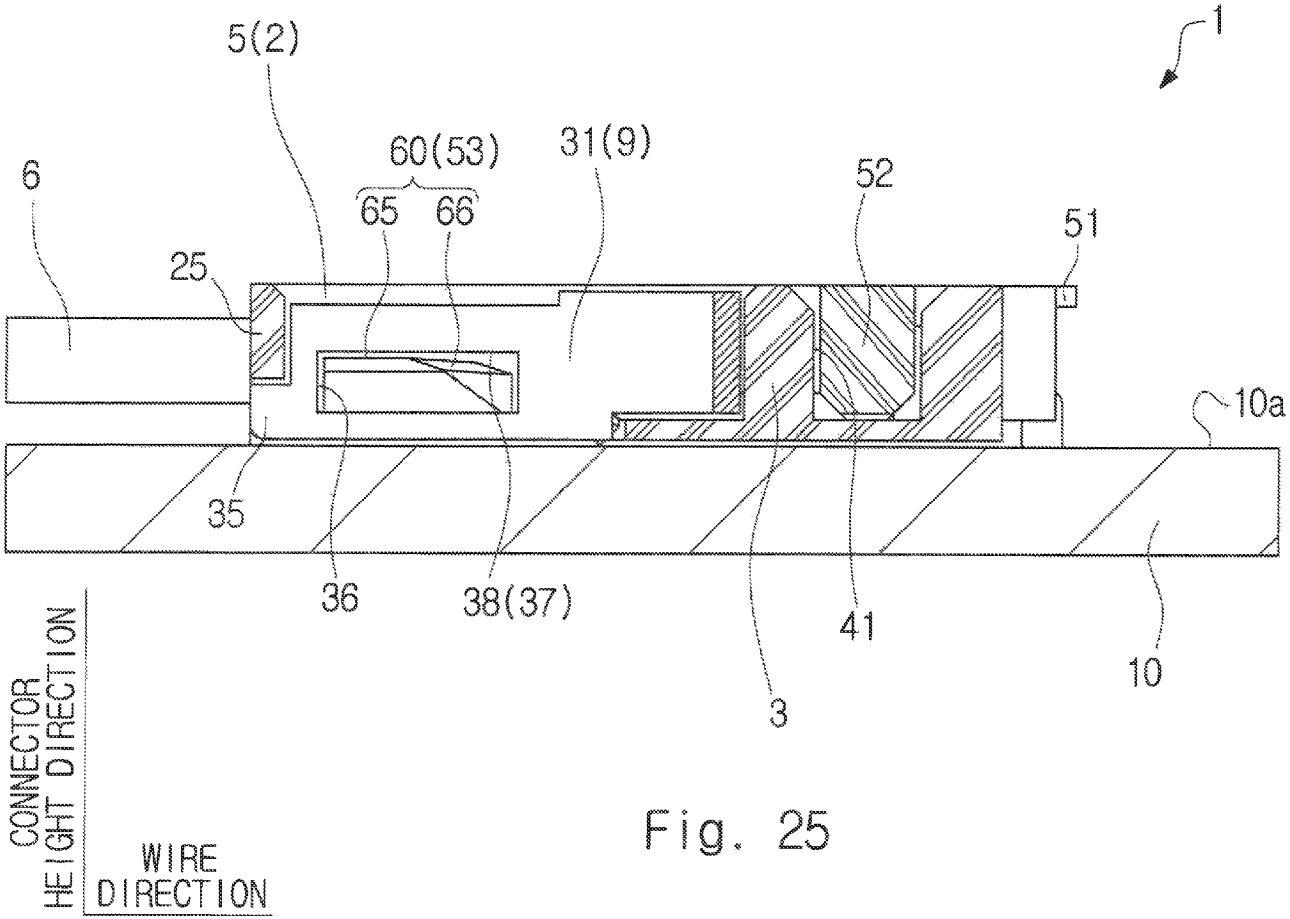
FIG. 25 corresponds to a sectional view taken along the line XXV-XXV of FIG. 16, and shows a state in which a plug connector is mated with a receptacle connector (first embodiment)

(3) As shown in FIG. 2, when the plug connector 2 is caused to descend toward the receptacle connector 3, each of the pair of claw portions 53 of the plug housing 5 shown in FIG. 17 is opposed to the lock beam 37 of the lock piece opposing portion 31 of the corresponding assistant fitting 9 shown in FIG. 15 in the connector height direction, due to the effect of positioning the plug connector 2 relative to the receptacle connector 3, which is exerted by the pair of positioning projections 52 shown in FIG. 17 and the pair of positioning grooves 41 shown in FIG. 3. Then, the mating guide surface 61 of the claw portion 53 shown in FIG. 20 contacts the assembly guide surface 40 of the lock beam 37 shown in FIG. 15. In this state, as the plug connector 2 is pushed toward receptacle connector 3, due to the presence of the mating guide surface 61 of the claw portion 53 shown in FIG. 20 and the assembly guide surface 40 of the lock beam 37 shown in FIG. 15, the claw portion 53 pushes out the lock beam 37 in the connector width anti-center direction, and descends while sliding on the plug opposing surface 39 of the lock beam 37. Eventually, when the claw portion 53 passes over the lock beam 37, the lock piece opposing portion 31 is allowed to return in the connector width center direction by the spring restoring force of the assistant fitting 9 and the claw portion 53 is accommodated in the lock hole 36. As a result, as shown in FIG. 25, the plug lock surface 60 of the claw portion 53 of the plug housing 5 of the plug connector 2 is opposed in the connector height direction to the receptacle lock surface 38 of the lock beam 37 of the lock piece opposing portion 31 of the assistant fitting 9 of the receptacle connector 3. The plug lock surface 60 and the receptacle lock surface 38 are opposed to each other in the connector height direction, thereby inhibiting the connector 2 from being disengaged from the receptacle connector 3.

Specifically, in the mated state shown in FIG. 25, the plurality of wires 6 may be raised in the direction away from the connector mounting surface 10*a* of the circuit board 10 due to some operation. When the wires 6 are raised in the direction away from the connector mounting surface 10*a* of the circuit board 10, the plug housing 5 is inclined while being rotated clockwise. When the plug housing 5 is inclined while being rotated clockwise, the lock maintaining surface 65 contacts the receptacle lock surface 38 in advance of the unlocking surface 66. In this embodiment, the lock maintaining angle θ1 of the lock maintaining surface 65 is set to be equal to or smaller than 90 degrees. Accordingly, when the wires 6 are raised in the direction away from the connector mounting surface 10*a* of the circuit board 10, the mated state is maintained without releasing the opposed relationship between the plug lock surface 60 and the receptacle lock surface 38.

(Method for Disengaging the Wire-to-Board Connector 1)

Figure 26:
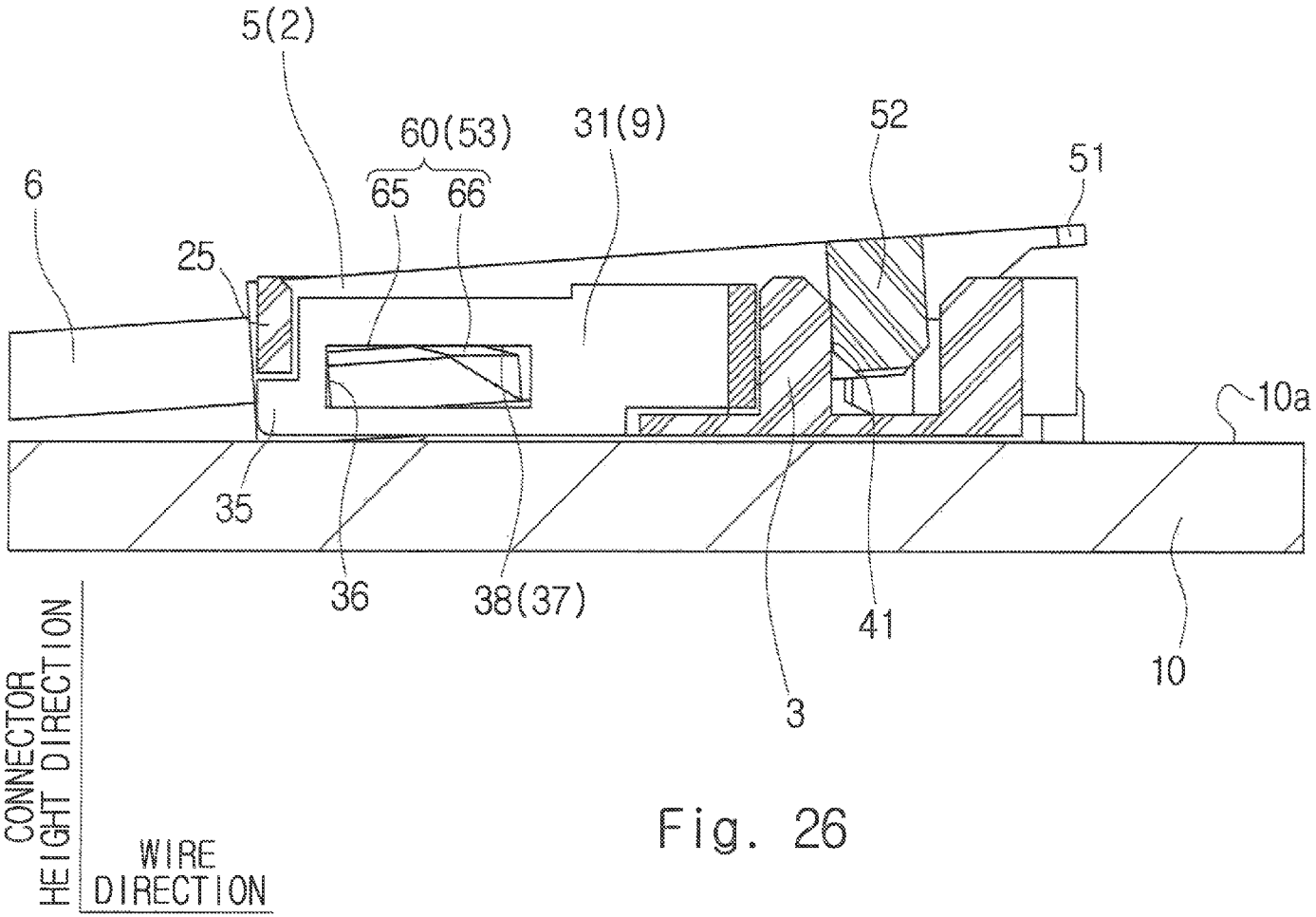
FIG. 26 corresponds to a sectional view taken along the line XXV-XXV of FIG. 16, and shows a state in which the plug connector is intentionally inclined (first embodiment)

On the other hand, as shown in FIG. 26, when a claw, a tool, a jig, or the like is hooked on the releasing projection 51 of the plug housing 5 of the plug connector 2 and the plug connector 2 is intentionally inclined while being rotated counterclockwise so that the wires 6 approach the connector mounting surface 10*a* of the circuit board 10, the unlocking surface 66 contacts the receptacle lock surface 38 in advance of the lock maintaining surface 65. In this embodiment, the unlocking angle θ2 of the unlocking surface 66 is set to be greater than 90 degrees. Accordingly, when the plug connector 2 is intentionally inclined so that the wires 6 approach the connector mounting surface 10*a* of the circuit board 10, the claw portion 53 pushes out the lock piece opposing portion 31 of the assistant fitting 9. At this time, since the displacement regulating portion 25 is disposed on a side opposite to the connector mounting surface 10*a* of the circuit board 10 with the regulated projection 35 of the lock piece opposing portion 31 interposed therebetween as shown in FIG. 15, the lock piece opposing portion 31 is regulated from being elastically displaced in the direction away from the connector mounting surface 10*a* of the circuit board 10. On the other hand, as shown in FIG. 16, the gap "h" is secured between the lock piece opposing portion 31 and the press-fit groove inner partition wall portion 24. Accordingly, when the claw portion 53 pushes out the lock piece opposing portion 31 of the assistant fitting 9, the lock piece opposing portion 31 is elastically displaced only in the connector width anti-center direction, without being elastically displaced in the board separating direction. The elastic displacement of the lock piece opposing portion 31 in the connector width anti-center direction releases the opposed relationship between the plug lock surface 60 and the receptacle lock surface 38, thereby releasing the mated state of the wire-to-board connector 1.

In sum, the preferred embodiment of the present invention described above has the following features.

(1) The wire-to-board connector 1 includes the plug connector 2 and the receptacle connector 3. The plug connector 2 includes the plug contacts 4 to which the wires 6 are respectively attached, and the plug housing 5 that holds the plug contacts 4. The receptacle connector 3 includes the receptacle contacts 7 respectively corresponding to the plug contacts 4, and the receptacle housing 8 that holds the receptacle contacts 7. The receptacle connector 3 is mounted on the connector mounting surface 10*a* of the circuit board 10 (board). The plug connector 2 is mated with the receptacle connector 3, thereby allowing the plug contacts 4 to respectively contact the receptacle contacts 7. In the mated state in which the plug connector 2 is mated with the receptacle connector 3, the vicinity portion 6*a* which is a portion located in the vicinity of the plug connector 2 of each wire 6 extends along the connector mounting surface 10*a* of the circuit board 10. The mating direction P in which the plug connector 2 is mated with the receptacle connector 3 is a direction approaching the connector mounting surface 10*a* of the circuit board 10. The plug housing 5 includes the plug side surfaces 50*a* serving as side surfaces of the plug housing 5. The receptacle connector 3 includes the side surface opposing portion R that is opposed to the corresponding plug side surface 50*a* in the mated state. Each plug side surface 50*a* is provided with the claw portion 53 that protrudes toward the side surface opposing portion R. The claw portion 53 includes the plug lock surface 60 that faces in the direction away from the connector mounting surface 10*a* of the circuit board 10 and extends in the wire direction which is specified as the longitudinal direction of the vicinity portion 6*a* in the mated state. The assistant fitting 9 in the side surface opposing portion R of the receptacle connector 3 includes the receptacle lock surface 38 that faces in the direction approaching the connector mounting surface 10*a* of the circuit board 10 and is opposed to the plug lock surface 60 in the mated state. The plug lock surface 60 includes the lock maintaining surface 65 that is disposed on a side in the connector wire direction which is the direction in which each wire 6 is viewed from the plug connector 2 in the wire direction, and the unlocking surface 66 that is disposed on a side in the wire connector direction which is a direction opposite to the connector wire direction. In a cross-section orthogonal to the wire direction, assuming that the angle formed between the lock maintaining surface 65 and the reference plane Q, which is a portion of the plug side surface 50*a* that is located on a side farther from the connector mounting surface 10*a* of the circuit board 10 than the claw portion 53, is the lock maintaining angle θ1 and the angle formed between the reference plane Q and the unlocking surface 66 is the unlocking angle θ2, the lock maintaining angle θ1 is smaller than the unlocking angle θ2.

Specifically, when the wires 6 are raised in the direction away from the connector mounting surface 10*a* of the circuit board 10 and the plug connector 2 is inclined, the lock maintaining surface 65 contacts the receptacle lock surface 38 in advance of the unlocking surface 66. On the other hand, when the plug connector 2 is intentionally inclined so that the wires 6 approach the connector mounting surface 10*a* of the circuit board 10, the unlocking surface 66 contacts the receptacle lock surface 38 in advance of the lock maintaining surface 65. Thus, according to the structure described above, when the wires 6 are raised in the direction away from the connector mounting surface 10*a* of the circuit board 10, the mated state is easily maintained without releasing the opposed relationship between the plug lock surface 60 and the receptacle lock surface 38, and when the plug connector 2 is intentionally inclined so that the wires 6 approach the connector mounting surface 10*a* of the circuit board 10, the opposed relationship between the plug lock surface 60 and the receptacle lock surface 38 is released, thereby facilitating the release of the mated state. Consequently, the wire-to-board connector 1 capable of maintaining the mated state even when the wires 6 are raised in the direction away from the connector mounting surface 10*a* of the circuit board 10 and capable of intentionally releasing the mated state is achieved.

Figure 27:
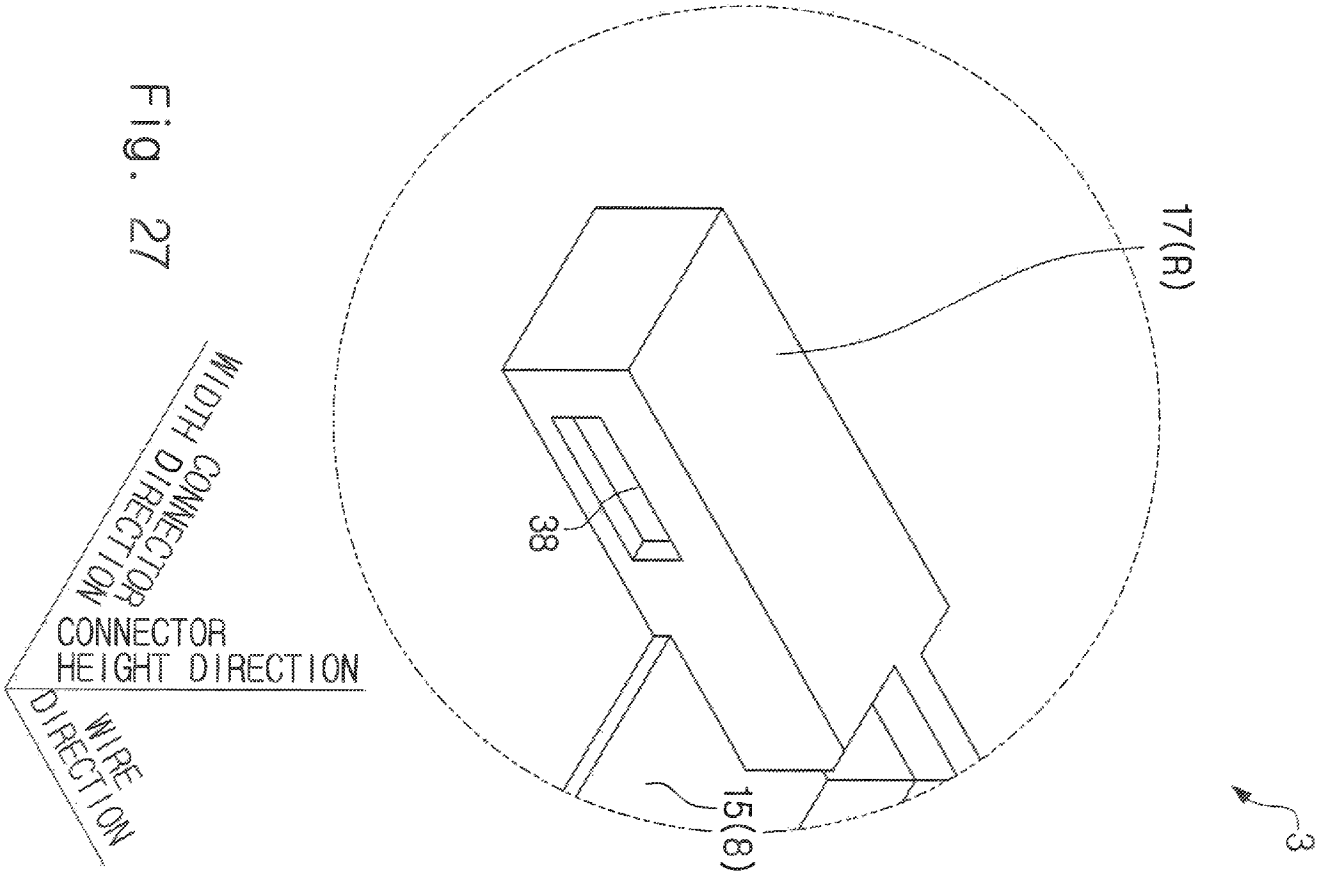
FIG. 27 is a perspective view showing a modified example of the receptacle connector.

The receptacle lock surface 38 is formed in the assistant fitting 9 of the side surface opposed portion R in this embodiment, but instead may be formed in the side portion 17 of the side surface opposed portion R. In a modified example shown in FIG. 27, the side surface opposing portion R does not include the assistant fitting 9. The side surface opposing portion R is formed of the side portion 17. The receptacle lock surface 38 is formed in the side portion 17.

(2) The unlocking angle θ2 is greater than 90 degrees. According to the structure described above, when the plug connector 2 is intentionally inclined so that the wires 6 approach the connector mounting surface 10*a* of the circuit board 10, the opposed relationship between the plug lock surface 60 and the receptacle lock surface 38 is released more easily.

(3) The lock maintaining angle θ1 is equal to or smaller than 90 degrees. According to the structure described above, when the wires 6 are raised in the direction away from the connector mounting surface 10*a* of the circuit board 10, the opposed relationship between the plug lock surface 60 and the receptacle lock surface 38 is less likely to be released.

(4) The unlocking surface 66 is inclined so as to approach the plug side surface 50*a* in the wire connector direction. According to the structure described above, when the plug connector is intentionally inclined so that the wires approach the connector mounting surface of the board, the opposed relationship between the plug lock surface and the receptacle lock surface can be released more smoothly.

(5) The unlocking surface 66 is connected to the edge 65*a* of the lock maintaining surface 65 on a side far from the plug side surface 50*a*. According to the structure described above, when the plug connector 2 is intentionally inclined so that the wires 6 approach the connector mounting surface 10*a* of the circuit board 10 and the opposed relationship between the plug lock surface 60 and the receptacle lock surface 38 is released, the receptacle lock surface 38 is prevented from being caught on the boundary between the unlocking surface 66 and the lock maintaining surface 65.

(6) The end inclined surface 64 (inclined surface) that is inclined so as to approach the plug side surface 50*a* in the wire connector direction is formed at an end in the wire connector direction of the claw portion 53. The end inclined surface 64 is connected to the unlocking surface 66. According to the structure described above, when the plug connector 2 is intentionally inclined so that the wires 6 approach the connector mounting surface 10*a* of the circuit board 10, the opposed relationship between the plug lock surface 60 and the receptacle lock surface 38 can be released more smoothly.

(7) The side surface opposing portion R includes the side portion 17 (lock piece supporting portion) and the assistant fitting 9 (lock piece) which is supported by the side portion 17. The assistant fitting 9 is formed in a cantilever shape including the lock piece held portion 30 which is held by the side portion 17, and the lock piece opposing portion 31 which is opposed to the plug side surface 50*a*. The lock piece opposing portion 31 is elastically displaceable in the direction away from the plug side surface 50*a*. The receptacle lock surface 38 is formed in the lock piece opposing portion 31. According to the structure described above, when the plug connector 2 is intentionally inclined so that the wires 6 approach the connector mounting surface 10*a* of the circuit board 10, the receptacle lock surface 38 is pushed out by the unlocking surface 66 in the direction away from the plug side surface 50*a*, so that the opposed relationship between the plug lock surface 60 and the receptacle lock surface 38 can be released more smoothly.

(8) The side portion 17 of the side surface opposing portion R includes the displacement regulating portion 25 that is disposed on the side opposite to the connector mounting surface 10*a* of the circuit board 10 with the regulated projection 35 of the lock piece opposing portion 31 interposed therebetween, thereby regulating the lock piece opposing portion 31 from being elastically displaced in the direction away from the connector mounting surface 10*a* of the circuit board 10. According to the structure described above, when the plug connector 2 is intentionally inclined so that the wires 6 approach the connector mounting surface 10*a* of the circuit board 10, the receptacle lock surface 38 is rapidly pushed out by the unlocking surface 66 in the direction away from the plug side surface 50*a*.

In this embodiment, the displacement regulating portion 25 is formed at the side portion 17 of the side surface opposing portion R, but instead may be formed at, for example, the lock piece held portion 30 of the assistant fitting 9 of the side surface opposing portion R.

(9) The lock piece held portion 30 and the lock piece opposing portion 31 are formed so as to extend in the wire direction. The above-mentioned structure contributes to a reduction in the height of the wire-to-board connector 1.

(10) An end in the wire connector direction of the lock piece held portion 30 and an end in the wire connector direction of the lock piece opposing portion 31 are coupled together.

(11) The plug housing 5 is provided with the releasing projection 51 that allows the plug connector 2 to be inclined so that the wires 6 approach the connector mounting surface 10*a* of the circuit board 10.

(12) The releasing projection 51 is formed so as to protrude in the wire connector direction from an end in the wire connector direction of the plug housing 5.

The preferred embodiment of the present invention described above can be modified in the following manner, for example.

Figure 28:
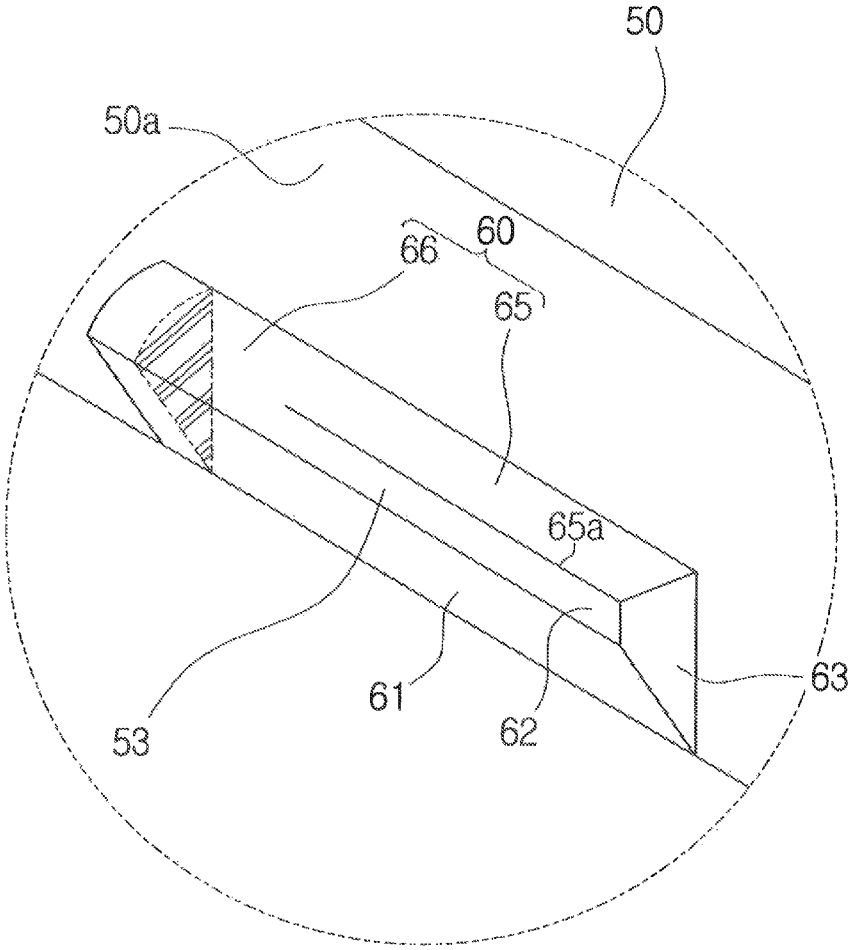
FIG. 28 is a view showing a modified example of an unlocking surface.
Figure 28:
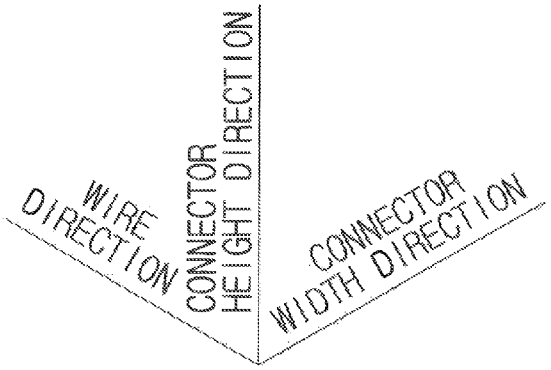
Figure 29:
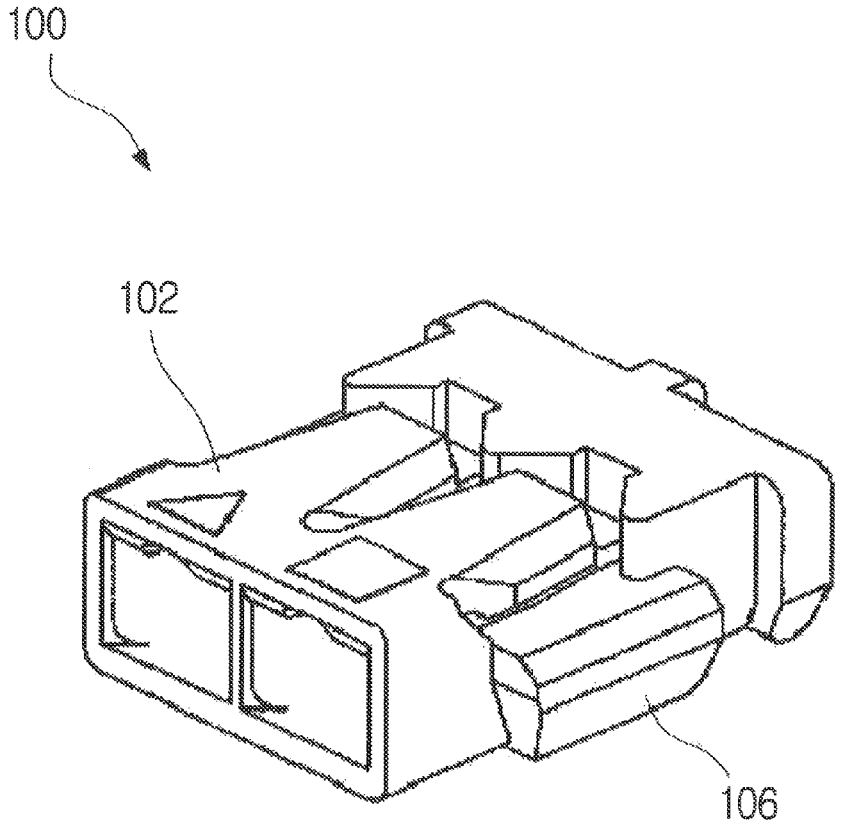
FIG. 29 is a view corresponding to FIG. 5 of Patent Literature 1.
Figure 30:
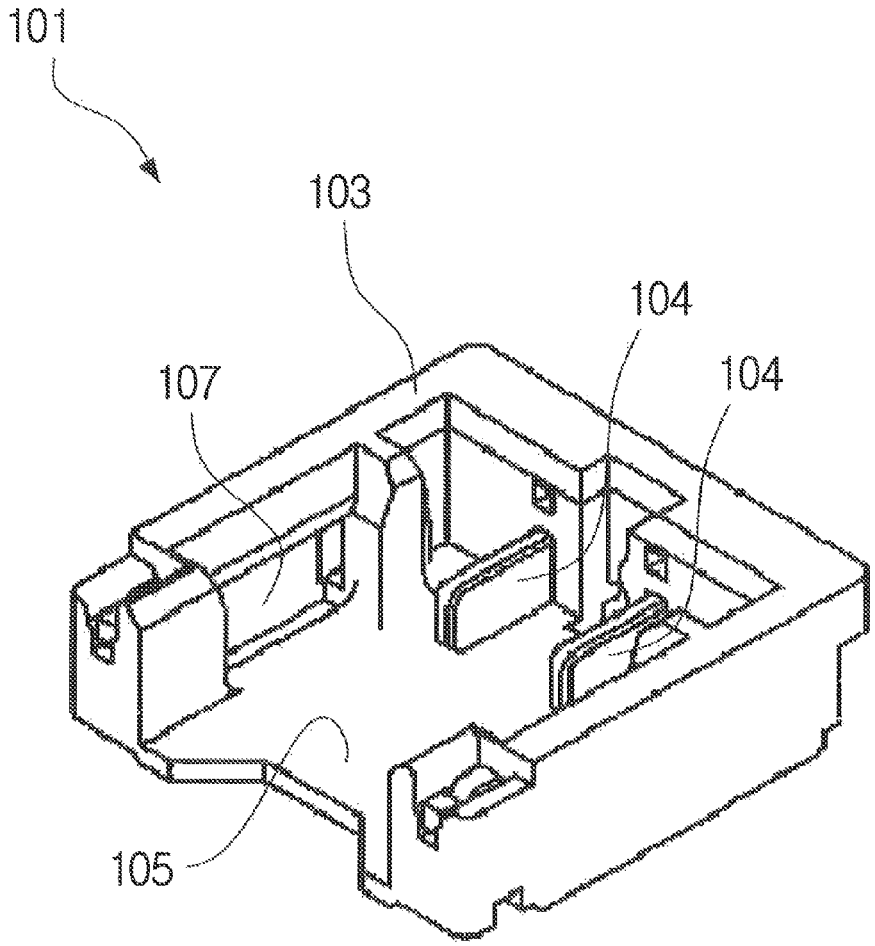
FIG. 30 is a view corresponding to FIG. 6 of Patent Literature 1.

In the embodiment described above, the unlocking surface 66 of the plug lock surface 60 is formed as a flat surface, but instead may be formed as a curved surface that is curved so as to approach the connector mounting surface 10*a* of the circuit board 10 in a direction away from the plug side surface 50*a* as shown in FIG. 28. FIG. 28 shows a cross-sectional shape of the curved unlocking surface 66 as indicated by a hatched area. Also in this case, the wire-to-board connector 1 capable of maintaining the mated state even when the wires 6 are raised in the direction away from the connector mounting surface 10*a* of the circuit board 10 and capable of intentionally releasing the mated state is achieved.

Upon assembly of the receptacle connector 3, the assistant fittings 9 are positioned relative to the respective side portions 17, and the assistant fittings 9 are pushed in the board approaching direction. However, instead, the assistant fittings 9 may be pushed in the board separating direction. That is, upon attachment of the assistant fittings 9 to the respective side portions 17, the attachment direction is not limited to the board approaching direction.

Second Embodiment

A second embodiment of the present invention will be described below with reference to FIGS. 31 to 34. Here, differences between this embodiment and the first embodiment will be mainly described, while a repeat of previous descriptions is omitted as appropriate. Components corresponding to the components of the first embodiment described above are denoted by the same reference numerals as a rule.

Figure 31:
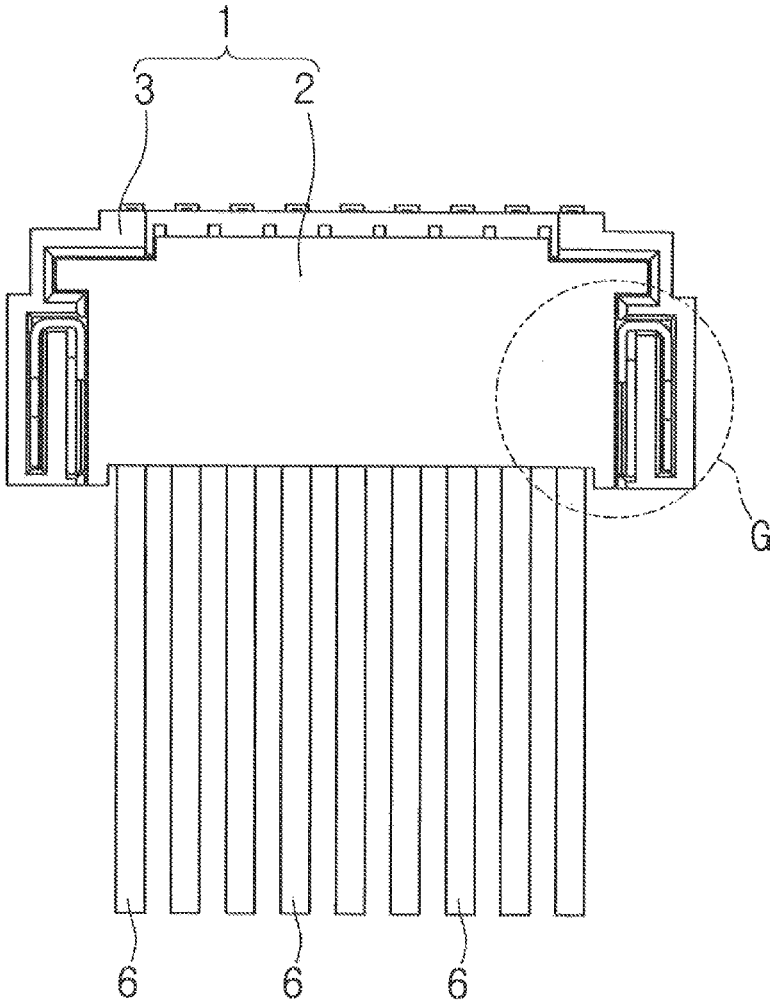
FIG. 31 is a plan view showing the mated state of the wire-to-board connector of the first embodiment.
Figure 31:
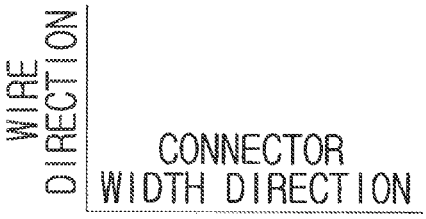

FIG. 31 shows the mated state of the wire-to-board connector 1. FIG. 32 is an enlarged view of a portion "G" shown in FIG. 31.

As shown in FIG. 32, the lock piece opposing portion 31 of the assistant fitting 9 of the receptacle connector 3 is supported in a cantilever manner. Accordingly, an end 31*a* which corresponds to the bottom of the lock piece opposing portion 31 and is located on the side of the lock piece coupling portion 32 of the lock piece opposing portion 31 is less likely to be elastically displaced in the connector width anti-center direction. If the plug housing body 50 of the plug housing 5 of the plug connector 2 happens to contact the end 31*a* located on the side of the lock piece coupling portion 32 of the lock piece opposed portion 31 of the assistant fitting 9 of the receptacle connector 3 when the plug connector 2 is mated with the receptacle connector 3, the mating of the plug connector 2 with the receptacle connector 3 is considerably inhibited because the end 31*a* is less likely to be elastically displaced in the connector width anti-center direction as described above.

To avoid such a problem, in the first embodiment described above, a gap "i" is left between the plug side surface 50*a* of the plug housing body 50 of the plug housing 5 of the plug connector 2 and the lock piece opposing portion 31 of the assistant fitting 9 of the receptacle connector 3 in the mated state of the wire-to-board connector 1.

However, due to the presence of the gap "i", the movement of the plug housing 5 of the plug connector 2 in the connector width direction is allowed within the receptacle connector 3 in the mated state of the wire-to-board connector 1 shown in FIG. 32. When the plug housing 5 of the plug connector 2 is moved in the connector width direction within the receptacle connector 3, the opposed relationship in the connector height direction between the receptacle lock surface 38 of the lock piece opposing portion 31 of the assistant fitting 9 shown in FIG. 15 and the lock maintaining surface 65 of the plug lock surface 60 of the claw portion 53 shown in FIG. 20 is weakened. This results in a problem that the plug connector 2 is liable to be disengaged from the receptacle connector 3.

As shown in FIG. 33, in this embodiment, each plug side surface 50*a* of the plug housing body 50 of the plug housing 5 of the plug connector 2 is provided with an overhanging portion 80 which projects toward the assistant fitting 9 (lock piece) of the side surface opposing portion R. That is, the overhanging portion 80 is formed so as to protrude in the connector width anti-center direction from the corresponding plug side surface 50*a* of the plug housing body 50. In the mated state of the wire-to-board connector 1 shown in FIG. 34, the overhanging portion 80 is in contact with an elastically displaceable portion of the lock piece opposing portion 31. According to the structure described above, in the mated state of the wire-to-board connector 1, the movement of the plug housing 5 of the plug connector 2 in the connector width direction within the receptacle connector 3 is suppressed by an elastic force N of the lock piece opposing portion 31 of the assistant fitting 9 of the receptacle connector 3 in the connector width center direction. As a result, the opposed relationship in the connector height direction between the receptacle lock surface 38 of the lock piece opposing portion 31 of the assistant fitting 9 shown in FIG. 15 and the lock maintaining surface 65 of the plug lock surface 60 of the claw portion 53 shown in FIG. 20 is maintained, thereby preventing the plug connector 2 from being easily disengaged from the receptacle connector 3.

Specifically, as shown in FIG. 33, the plug housing 5 of the plug connector 2 includes a pair of overhanging portions 80 in addition to the plug housing body 50, the releasing projection 51, the pair of positioning projections 52, and the pair of claw portions 53. Each overhanging portion 80 is formed so as to protrude in the connector width anti-center direction from the corresponding plug side surface 50*a*. The overhanging portion 80 is formed at a location as far as possible from the corresponding positioning projection 52. The overhanging portion 80 includes an overhanging surface 80*a* that faces in the connector width anti-center direction. The overhanging surface 80*a* is orthogonal to the connector width direction. Since the overhanging portions 80 are respectively formed on the plug side surfaces 50*a* of the plug housing body 50, the overhanging surface 80*a* of each overhanging portion 80 can be regarded as a part of the plug side surfaces 50*a* of the plug housing body 50. The overhanging portions 80 are respectively provided with the claw portions 53. Specifically, each claw portion 53 is formed on the overhanging surface 80*a* of the corresponding overhanging portion 80. The claw portion 53 is formed so as to protrude in the connector width anti-center direction from the overhanging surface 80*a* of the corresponding overhanging portion 80.

Since each overhanging portion 80 is formed at a location as far as possible from the corresponding positioning projection 52 as shown in FIG. 33, the overhanging portion 80 is apart from the end 31*a* of the lock piece opposing portion 31 in the connector wire direction in the mated state of the wire-to-board connector 1 as shown in FIG. 34. As a result, in the mated state of the wire-to-board connector 1, the overhanging portion 80 is constantly in contact with the elastically displaceable portion of the lock piece opposing portion 31. On the other hand, the above-mentioned gap "i" still exists between the plug side surface 50*a* and the vicinity of the end 31*a* of the lock piece opposing portion 31. Accordingly, also in this embodiment in which the overhanging portions 80 are provided, it is possible to effectively prevent the plug housing body 50 of the plug housing 5 of the plug connector 2 from contacting the end 31*a* located on the side of the lock piece coupling portion 32 of the lock piece opposed portion 31 of the assistant fitting 9 of the receptacle connector 3 when the plug connector 2 is mated with the receptacle connector 3, as in the first embodiment described above. Therefore, the mating of the plug connector 2 with the receptacle connector 3 is not inhibited.

Third Embodiment

Next, a third embodiment of the present invention will be described with reference to FIGS. 35 and 36. Here, differences between this embodiment and the second embodiment will be mainly described, while a repeat of previous descriptions is omitted as appropriate. Components corresponding to the components of the second embodiment described above are denoted by the same reference numerals as a rule.

Figure 35:
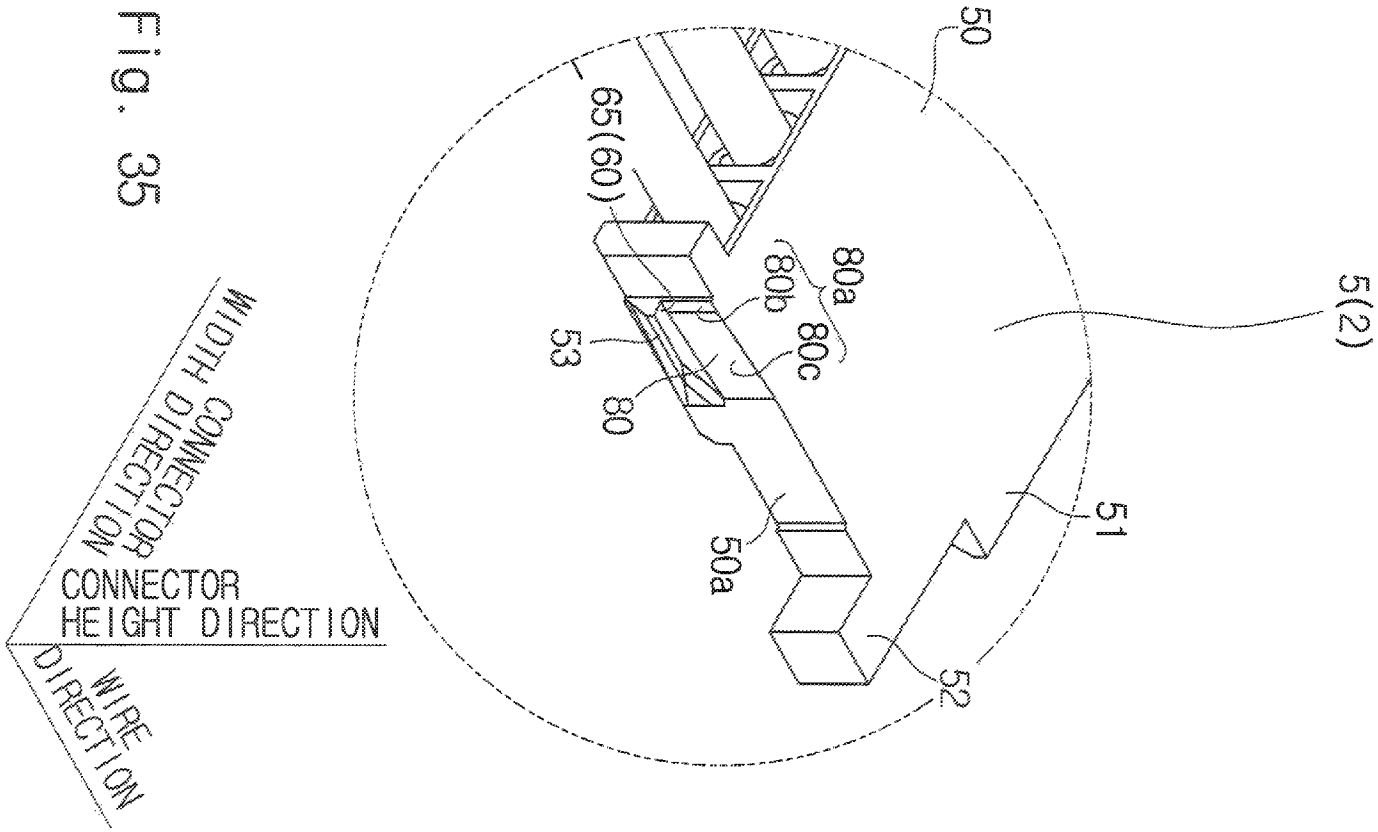
FIG. 35 is a partial perspective view of a plug connector to which a plurality of wires are attached (third embodiment)

As shown in FIG. 35, in this embodiment, the overhanging surface 80*a* of each overhanging portion 80 includes a first overhanging surface 80*b* and a second overhanging surface 80*c*. The first overhanging surface 80*b* is connected to an end in the connector wire direction of the second overhanging surface 80*c*. That is, the second overhanging surface 80*c* is connected to an end in the wire connector direction of the first overhanging surface 80*b*. The first overhanging surface 80*b* faces in the connector width anti-center direction. The first overhanging surface 80*b* is orthogonal to the connector width direction. The first overhanging surface 80*b* is connected to an end in the connector wire direction of the lock maintaining surface 65 of the plug lock surface 60 of the claw portion 53. The second overhanging surface 80*c* is inclined in the connector width center direction toward the wire connector direction.

In this structure, as shown in FIG. 36, when the plug connector 2 is mated with the receptacle connector 3, only the first overhanging surface 80*b* of the overhanging portion 80 is constantly in contact with the lock piece opposing portion 31, and the second overhanging surface 80*c* of the overhanging portion 80 does not contact the lock piece opposing portion 31. Further, the first overhanging surface 80*b* is connected to the end in the connector wire direction of the lock maintaining surface 65 of the claw portion 53. Accordingly, regardless of how much the lock piece opposing portion 31 is elastically displaced in the connector width anti-center direction due to the contact between the overhanging portion 80 and the lock piece opposing portion 31, the elastic displacement has no influence on the opposed relationship in the connector height direction between the receptacle lock surface 38 of the lock piece opposing portion 31 of the assistant fitting 9 shown in FIG. 15 and the lock maintaining surface 65 of the plug lock surface 60 of the claw portion 53 shown in FIG. 20.

This application is based upon and claims the benefit of priority from Japanese patent application No. 2012-072085, filed on Mar. 27, 2012, and Japanese patent application No. 2012-247408, filed on Nov. 9, 2012, the disclosure of which is incorporated herein in its entirety by reference.

REFERENCE SIGNS LIST

1 WIRE-TO-BOARD CONNECTOR
2 PLUG CONNECTOR
3 RECEPTACLE CONNECTOR
4 PLUG CONTACT
4*a* CONTACT PIECE
5 PLUG HOUSING
6 WIRE
6*a* VICINITY PORTION
7 RECEPTACLE CONTACT
7*a* SOLDERED LEG PORTION
8 RECEPTACLE HOUSING
9 ASSISTANT FITTING (LOCK PIECE)
10 CIRCUIT BOARD (BOARD)
10*a* CONNECTOR MOUNTING SURFACE
15 BOARD OPPOSING PORTION
16 RECEPTACLE CONTACT HOLDING PORTION
17 SIDE PORTION (LOCK PIECE SUPPORTING PORTION)
18 RECEPTACLE CONTACT MOUNTING HOLE
19 END
20 POSITIONING GROOVE SIDE PARTITION WALL PORTION
21 POSITIONING GROOVE FRONT PARTITION WALL PORTION
22 PRESS-FIT GROOVE SIDE PARTITION WALL PORTION
23 PRESS-FIT GROOVE FRONT PARTITION WALL PORTION
24 PRESS-FIT GROOVE INNER PARTITION WALL PORTION
24*a* END
25 DISPLACEMENT REGULATING PORTION
26 PRESS-FIT GROOVE
27 INCLINED GUIDE SURFACE
28 ERECT GUIDE SURFACE
29 REGULATING SURFACE
30 LOCK PIECE HELD PORTION
30*a* PRESS-FITTED PORTION
31 LOCK PIECE OPPOSING PORTION
31*a* END
32 LOCK PIECE COUPLING PORTION
33 SOLDERED LEG PORTION
34 OPPOSING PORTION BODY
35 REGULATED PROJECTION
35*a* REGULATED SURFACE
36 LOCK HOLE
37 LOCK BEAM
38 RECEPTACLE LOCK SURFACE
39 PLUG OPPOSING SURFACE
40 ASSEMBLY GUIDE SURFACE
41 POSITIONING GROOVE
50 PLUG HOUSING BODY
50*a* PLUG SIDE SURFACE
51 RELEASING PROJECTION
52 POSITIONING PROJECTION
53 CLAW PORTION
54 PLUG CONTACT MOUNTING HOLE
60 PLUG LOCK SURFACE
61 MATING GUIDE SURFACE
62 SIDE STANDING SURFACE
63 END STANDING SURFACE
64 END INCLINED SURFACE (INCLINED SURFACE)
65 LOCK MAINTAINING SURFACE
65*a* EDGE
66 UNLOCKING SURFACE
80 OVERHANGING PORTION
80*a* OVERHANGING SURFACE
80*b* FIRST OVERHANGING SURFACE
80*c* SECOND OVERHANGING SURFACE
h GAP
i GAP
g GAP
N ELASTIC FORCE
P MATING DIRECTION
Q REFERENCE PLANE
R SIDE SURFACE OPPOSING PORTION
X CROSS-SECTION
Y CROSS-SECTION
Z CROSS-SECTION
θ1 LOCK MAINTAINING ANGLE
θ2 UNLOCKING ANGLE

The invention claimed is:

1. A wire-to-board connector comprising:

a plug connector including a plug contact to which a wire is attached, and a plug housing that holds the plug contact; and a receptacle connector that is mounted on a connector mounting surface of a board and includes a receptacle contact corresponding to the plug contact, and a receptacle housing that holds the receptacle contact, the plug connector being mated with the receptacle connector to thereby allow the plug contact to contact the receptacle contact, wherein in a mated state in which the plug connector is mated with the receptacle connector, a vicinity portion of the wire, the vicinity portion being located in the vicinity of the plug connector, extends along the connector mounting surface of the board, a mating direction in which the plug connector is mated with the receptacle connector is a direction approaching the connector mounting surface of the board, the plug housing includes a plug side surface as a side surface of the plug housing, the receptacle connector includes a side surface opposing portion that is opposed to the plug side surface in the mated state, the plug side surface is provided with a claw portion projecting toward the side surface opposing portion, the claw portion includes a plug lock surface that faces in a direction away from the connector mounting surface of the board and extends in a wire direction specified as a longitudinal direction of the vicinity portion in the mated state, the side surface opposing portion of the receptacle connector includes a receptacle lock surface that faces in a direction approaching the connector mounting surface of the board and is opposed to the plug lock surface in the mated state, the plug lock surface includes a lock maintaining surface disposed on a side in a connector wire direction in which the wire is viewed from the plug connector in the wire direction, and an unlocking surface disposed on a side in a wire connector direction which is opposite to the connector wire direction, and in a cross-section orthogonal to the wire direction, wherein that an angle formed between the lock maintaining surface and a reference plane that is a portion of the plug side surface located on a side farther from the connector mounting surface of the board than the claw portion is a lock maintaining angle θ1 and an angle formed between the reference plane and the unlocking surface is an unlocking angle θ2, the lock maintaining angle θ1 is smaller than the unlocking angle θ2.

2. The wire-to-board connector according to claim 1, wherein the unlocking angle θ2 is greater than 90 degrees.

3. The wire-to-board connector according to claim 1, wherein the lock maintaining angle θ1 is equal to or smaller than 90 degrees.

4. The wire-to-board connector according to claim 1, wherein the unlocking surface is inclined so as to approach the plug side surface in the wire connector direction.

5. The wire-to-board connector according to claim 1, wherein the unlocking surface is connected to an edge of the lock maintaining surface on a side far from the plug side surface.

6. The wire-to-board connector according to claim 1, wherein at an end in the wire connector direction of the claw portion, an inclined surface that is inclined so as to approach the plug side surface in the wire connector direction is formed, and the inclined surface is connected to the unlocking surface.

7. The wire-to-board connector according to claim 1 wherein the side surface opposing portion includes a lock piece supporting portion and a lock piece that is supported by the lock piece supporting portion, the lock piece is formed in a cantilever shape including a lock piece held portion that is held by the lock piece supporting portion, and a lock piece opposing portion that is opposed to the plug side surface, the lock piece opposing portion is elastically displaceable in a direction away from the plug side surface, and the receptacle lock surface is formed in the lock piece opposing portion.

8. The wire-to-board connector according to claim 7, wherein the side surface opposing portion includes a displacement regulating portion that is disposed on a side opposite to the connector mounting surface of the board with the lock piece opposing portion interposed therebetween, thereby regulating the lock piece opposing portion from being elastically displaced in a direction away from the connector mounting surface of the board.

9. The wire-to-board connector according to claim 7, wherein the lock piece held portion and the lock piece opposing portion are formed so as to extend in the wire direction.

10. The wire-to-board connector according to claim 9, wherein an end in the wire connector direction of the lock piece held portion is coupled with an end in the wire connector direction of the lock piece opposing portion.

11. The wire-to-board connector according to claim 1, wherein the plug housing is provided with a releasing projection that allows the plug connector to be inclined in such a manner that the wire approaches the connector mounting surface of the board.

12. The wire-to-board connector according to claim 11, wherein the releasing projection is formed so as to protrude in the wire connector direction from an end in the wire connector direction of the plug housing.

13. A wire-to-board connector comprising:

a plug connector including a plug contact to which a wire is attached, and a plug housing that holds the plug contact; and a receptacle connector that is mounted on a connector mounting surface of a board and includes a receptacle contact corresponding to the plug contact, and a receptacle housing that holds the receptacle contact, the plug connector being mated with the receptacle connector to thereby allow the plug contact to contact the receptacle contact, wherein in a mated state in which the plug connector is mated with the receptacle connector, a vicinity portion of the wire, the vicinity portion being located in the vicinity of the plug connector, extends along the connector mounting surface of the board, a mating direction in which the plug connector is mated with the receptacle connector is a direction approaching the connector mounting surface of the board, the plug housing includes a plug side surface as a side surface of the plug housing, the receptacle connector includes a side surface opposing portion that is opposed to the plug side surface in the mated state, the plug side surface is provided with a claw portion projecting toward the side surface opposing portion, the claw portion includes a plug lock surface that faces in a direction away from the connector mounting surface of the board and extends in a wire direction specified as a longitudinal direction of the vicinity portion in the mated state, the side surface opposing portion of the receptacle connector includes a receptacle lock surface that faces in a direction approaching the connector mounting surface of the board and is opposed to the plug lock surface in the mated state, the plug lock surface includes a lock maintaining surface disposed on a side in a connector wire direction in which the wire is viewed from the plug connector in the wire direction, and an unlocking surface disposed on a side in a wire connector direction which is opposite to the connector wire direction, and the unlocking surface is formed to be curved so as to approach the connector mounting surface of the board in a direction away from the plug side surface.

14. A wire-to-board connector comprising:

a plug connector including a plug contact to which a wire is attached, and a plug housing that holds the plug contact; and a receptacle connector that is mounted on a connector mounting surface of a board and includes a receptacle contact corresponding to the plug contact, and a receptacle housing that holds the receptacle contact, the plug connector being mated with the receptacle connector to thereby allow the plug contact to contact the receptacle contact, wherein in a mated state in which the plug connector is mated with the receptacle connector, a vicinity portion of the wire, the vicinity portion being located in the vicinity of the plug connector, extends along the connector mounting surface of the board, a mating direction in which the plug connector is mated with the receptacle connector is a direction approaching the connector mounting surface of the board, the plug housing includes a plug side surface as a side surface of the plug housing, the receptacle connector includes a side surface opposing portion that is opposed to the plug side surface in the mated state, the plug side surface is provided with a claw portion projecting toward the side surface opposing portion, the claw portion includes a plug lock surface that faces in a direction away from the connector mounting surface of the board and extends in a wire direction specified as a longitudinal direction of the vicinity portion in the mated state, the side surface opposing portion of the receptacle connector includes a receptacle lock surface that faces in a direction approaching the connector mounting surface of the board and is opposed to the plug lock surface in the mated state, the plug lock surface includes a lock maintaining surface disposed on a side in a connector wire direction in which the wire is viewed from the plug connector in the wire direction, and an unlocking surface disposed on a side in a wire connector direction which is opposite to the connector wire direction, in a cross-section orthogonal to the wire direction, wherein that an angle formed between the lock maintaining surface and a reference plane that is a portion of the plug side surface located on a side farther from the connector mounting surface of the board than the claw portion is a lock maintaining angle $\theta 1$ and an angle formed between the reference plane and the unlocking surface is an unlocking angle $\theta 2$, the lock maintaining angle $\theta 1$ is smaller than the unlocking angle $\theta 2$, the side surface opposing portion includes a lock piece supporting portion and a lock piece that is supported by the lock piece supporting portion, the lock piece is formed in a cantilever shape including a lock piece held portion that is held by the lock piece supporting portion, and a lock piece opposing portion that is opposed to the plug side surface, the lock piece opposing portion is elastically displaceable in a direction away from the plug side surface, and the plug side surface of the plug housing is provided with an overhanging portion projecting toward the lock piece of the side surface opposing portion, and the overhanging portion is in contact with an elastically displaceable portion of the lock piece opposing portion in the mated state.

* * * * *